US006547577B2

(12) United States Patent
Fujita et al.

(10) Patent No.: US 6,547,577 B2
(45) Date of Patent: Apr. 15, 2003

(54) CARD EDGE CONNECTOR

(75) Inventors: Shinya Fujita, Yokkaichi (JP); Hitoshi Okumura, Yokkaichi (JP); Toshikazu Sakurai, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/029,274

(22) Filed: Dec. 28, 2001

(65) Prior Publication Data

US 2002/0086571 A1 Jul. 4, 2002

(30) Foreign Application Priority Data

Dec. 28, 2000 (JP) ..... 2000-401594
Jan. 9, 2001 (JP) ..... 2001-001766
Mar. 19, 2001 (JP) ..... 2001-078305

(51) Int. Cl.[7] ..... H01R 29/00
(52) U.S. Cl. ..... 439/188; 439/140
(58) Field of Search ..... 439/188, 260, 439/267, 67, 635, 636, 637, 630, 137, 140

(56) References Cited

U.S. PATENT DOCUMENTS 4,815,895 A 3/1989 Purssey et al. ..... 405/153
5,160,275 A * 11/1992 Nakamura et al. ..... 439/328

FOREIGN PATENT DOCUMENTS

EP 35354 8/1984

* cited by examiner

*Primary Examiner*—P. Austin Bradley
*Assistant Examiner*—Ross Gushi
(74) *Attorney, Agent, or Firm*—Banner & Witcoff, Ltd.

(57) ABSTRACT

In order to prevent terminal fittings of a card edge connector from short circuiting, a housing 11 is provided with a short circuit preventing member 50 made from insulating material. This short circuit preventing member 50 can be moved between a short circuit preventing position, between resilient contacts 42 of terminal fittings 40 provided at mutually opposing upper and lower locations, and a retreated position, which is to the posterior of the short circuit preventing position. Since the upper and lower terminal fittings 40 are prevented from short circuiting when the short circuit preventing member 50 is in the short circuit preventing position, the resilient contacts 42 are bendable to a greater degree, thus increasing their contacting force with contacts of a card edge connector.

11 Claims, 21 Drawing Sheets

CARD EDGE CONNECTOR

TECHNICAL FIELD

The present invention relates to a card edge connector.

BACKGROUND TO THE INVENTION

FIGS. 47 and 48 of this specification show a card edge connector 100 which is described in JP 56-136480. An anterior face of the card edge connector 100 is provided with a base plate insertion hole 102 into which an end of a base plate 101 can be inserted. The interior of the card edge connector 100 has a pair of terminal fittings 104 which are provided with resilient contacts 103, and which are located symmetrically on either side of the base plate insertion hole 102. The distance L separating the two resilient contacts 103 is less than the thickness M of the base plate 101. When the base plate 101 has been attached to the card edge connector 100, the two resilient contacts 103 resiliently grip the base plate 101 while making contact with thin film-like terminals 105 provided on both faces of the base plate 101.

In this card edge connector 100, the contacting resistance between the terminal fittings 104 and the terminals 105 is stabilised by increasing the contacting force between the resilient contacts 103 and the terminals 105. If the resilient contacts 103 are caused to bend to a greater degree in order to achieve this aim, the distance L therebetween decreases. As a result, these upper and lower resilient contacts 103 may be more likely to make mutual contact before the base plate 101 is attached, thereby causing a circuit (not shown) of the card edge connector 100 to short circuit.

The present invention has taken the above problem into consideration, and aims to present a card edge connector wherein terminal fittings are not short circuited.

SUMMARY OF THE INVENTION

According to the invention there is provided a card edge connector comprising a housing having a slot adapted to receive the edge of a card having surface contacts, and opposed resilient terminals within said slot for contact with said surface contacts, said connector further including short circuit preventing member of electrically insulating material, said preventing member being movable from an advanced position between said opposed terminals to a retreated position not between said opposite terminals.

Preferably the preventing member is movable by direct contact with a card edge connector inserted into said slot.

Such an arrangement reliably prevents short-circuiting of the opposed terminals, and accordingly these terminals can be given an increased contact force so that a reliable engagement of the card edge contacts is assured.

In a preferred embodiment the preventing member is latchable in the advanced and retreated positions, and may be entrained for movement with a card edge connector between predetermined limits. The latter feature ensures that the preventing member is returned to the advanced condition should the connector be separated from the contacts of a card edge.

BRIEF DESCRIPTION OF THE DRAWING

Other features of the invention will be apparent from the following description of preferred embodiments shown by way of example only in the accompanying drawings in which.

DESCRIPTION OF PREFERRED EMBODIMENTS

Figure 1:
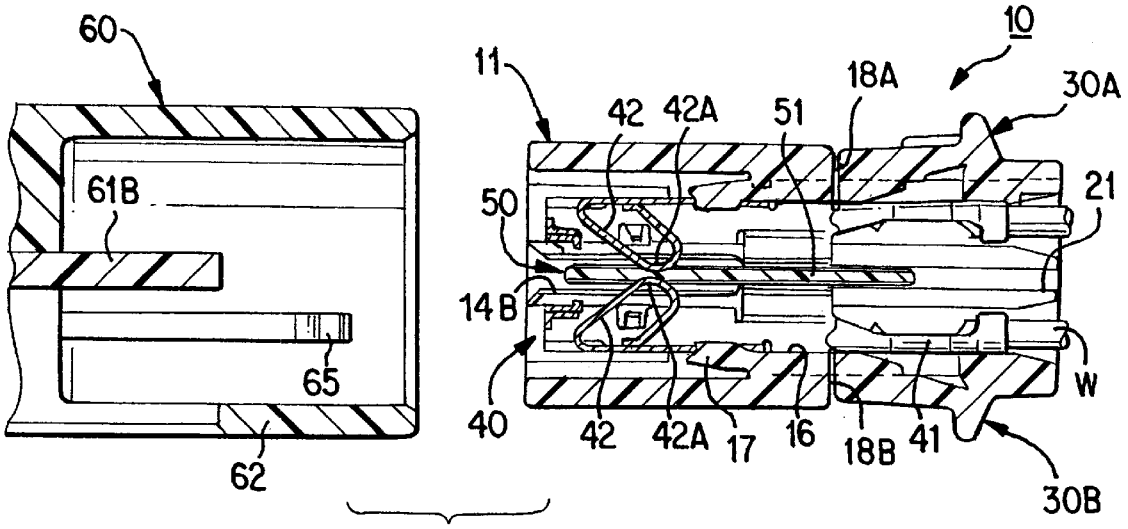
FIG. 1 is a side cross-sectional view of a card edge connector of a first embodiment prior to being fitted together.

A first embodiment of the present invention is described below with the aid of FIGS. 1 to 18.

As shown in FIGS. 1 to 6, a card edge connector 10 of the present embodiment is provided with a plastic housing 11, terminal fittings 40 which can be inserted into the housing 11, retainers 30A and 30B which are attached to the housing 11 as an upper and lower pair and which retain the terminal fittings 40, and a short circuit preventing member 50 which prevents the terminal fittings 40 from short circuiting. The housing 11 fits with a corresponding housing 60 provided with a pair of base plates 61A and 61B. In the following description, fittings sides of the two housings 11 and 60 are considered to be the anterior face sides. Furthermore, only a portion of the corresponding housing 60 is shown.

The housing 11, which is approximately box shaped and is along and narrow in a left-right direction, fits into a hood 62 of the corresponding housing 60. A groove 12 is formed in an upper face of the housing 11 in the vicinity of the centre, relative to the left-right direction thereof. A locking arm 13, which is capable of bending in an up-down direction, is provided in this groove 12. When the two housings 11 and 10 have been fitted together, the locking arm 13 engages resiliently with a lock receiving member 63 provided on the hood 62, this locking the two housings 11 and 60 in a latched state. The base plates 61A and 61B, which are aligned in a left-right direction, protrude from an inner face of the hood 62, from a central location thereof relative to the up-down direction. A pair of base plate insertion holes 14A and 14B open into an anterior face of the housing 11 at locations corresponding to the base plates 61A and 61B. Fitting the two housings 11 and 60 together causes the base plates 61A and 61B to be inserted into the base plate insertion holes 14A and 14B respectively.

The housing 11 is provided with a plurality of cavities 16 which are aligned symmetrically above and below the base plate insertion holes 14A and 14B. Upper and lower terminal fittings 40 can be inserted into these cavities 16. Thin film-like terminals (not shown) are provided in upper and lower faces of ends of the base plates 61A and 61B which are inserted into the base plate insertion holes 14A and 14B. These thin terminals are formed from copper foil, or the like. The cavities 16, which are located so as to correspond these terminals, are long and narrow in an anterior-posterior direction, posterior ends thereof being open to allow the terminal fittings 40 to be inserted therefrom. The upper and lower rows of cavities 16 are symmetrical. A lance 17 protrudes inwards from an inner wall of each cavity 16 (from the outermost inner wall). These lances 17 are capable of bending in an up-down direction. Tips thereof engage resiliently with the terminal fittings 40, thereby preventing their removal.

A pair of concave retainer attachment holes 18A and 18B, within which the retainers 30A and 30B are fitted, are formed in upper and lower faces respectively of the housing 11 at locations somewhat towards the posterior end thereof. The retainer attachment holes 18A and 18B adjoin the cavities and extend across the entire width of the housing 11. The retainers 30A and 30B are cross-sectional U-shaped and are attached so as to straddle the housing 11 from left to right. Although a detailed description of the retainers 30A and 30B is omitted, they are formed such that they retain the terminal fittings 40 and are capable of moving between a temporary retaining position, this allowing the terminal fittings 4*o* to be removed from or inserted into the cavities 16, and a main retaining position, whereby the retainers 30A and 30B are inserted more deeply than in the temporary retaining position and in which they engage with the terminal fittings 40, thereby preventing their removal.

Each terminal fitting 40 is formed by bending electrically conductive sheet metal. A posterior portion thereof is provided with an electric wire connecting member 41, to which an end of an electric wire W can be connected. An anterior end thereof is provided with a resilient contact 42 which makes resilient contact with the base plates 61A and 61B. With reference to the terminal fitting 40 of the lower cavity 16 shown in FIG. 1, the resilient contact 42 is shaped such that a ribbon-shaped portion thereof that extends beyond an anterior end of a base face of the terminal fitting 40 is bent obliquely upwards and towards the posterior, then an end thereof is again bent obliquely downwards and towards the anterior. An upper end of each resilient contact 42 forms a contacting member 42A. The upper and lower terminal fittings 40 are located symmetrically such that the contacting members 42A of the resilient contacts 42 thereof protrude towards one another. Furthermore, the contacting members 42A of the upper and lower terminal fittings 40 protrude into the base plate insertion holes 14A and 14B respectively. When the base plates 61A and 61B respectively are inserted into these base plate insertion holes 14A and 14B, the contacting members 42A resiliently grip the base plates 61A and 61B and make electrical contact with the terminals provided on both faces thereof.

Figure 4:
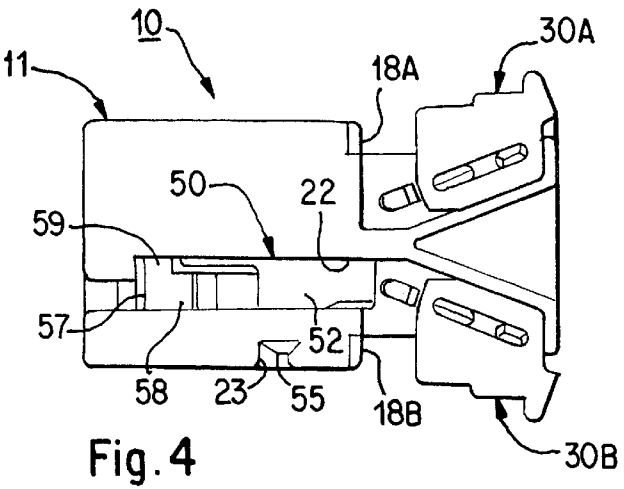
FIG. 4 is a side face view of the card edge connector.
Figure 6:
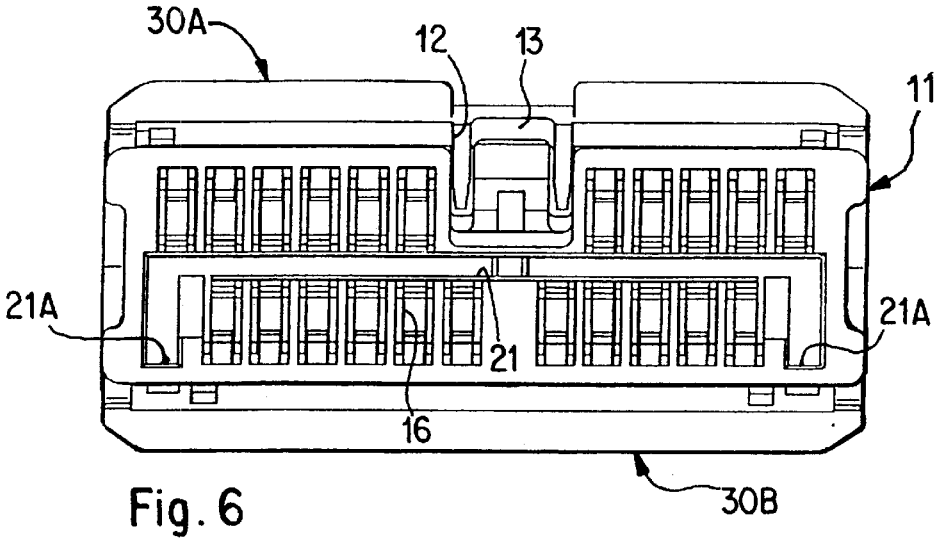
FIG. 6 is a rear face view of the housing.

A member housing hole 21, which is capable of housing the short circuit preventing member 50, is provided in the housing 11. As shown in FIG. 6, this member housing hole 21 has an inverted U-shape when viewed from the posterior, and is open to the posterior of the housing 11. The central portion of the member housing hole 21 divided the interior of the housing 11 into upper and lower portions, this member housing 21 also separating the upper and lower rows of cavities 16. The base plate insertion holes 14A and 14B and an anterior portion of the member housing hole 21 extend partially along a common domain. The left and right side ends of the member housing hole 21 form side grooves 21A that extend downwards. As shown in FIG. 4, window holes 22 pass through left and right side faces of the housing 11, these adjoining portions of the side grooves 21A.

Figure 8:
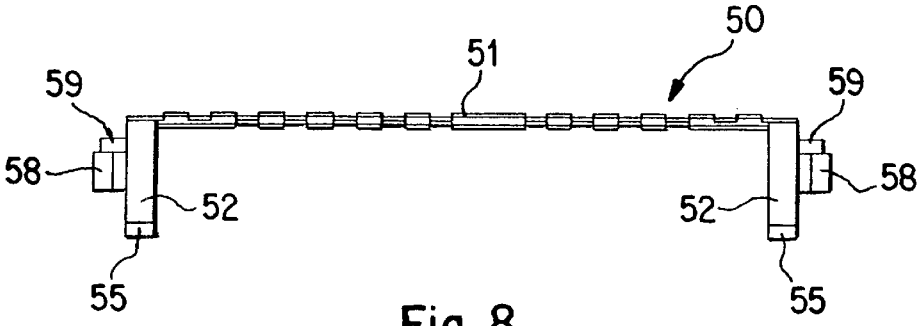
FIG. 8 is a front view of the short circuit preventing member.
Figure 9:
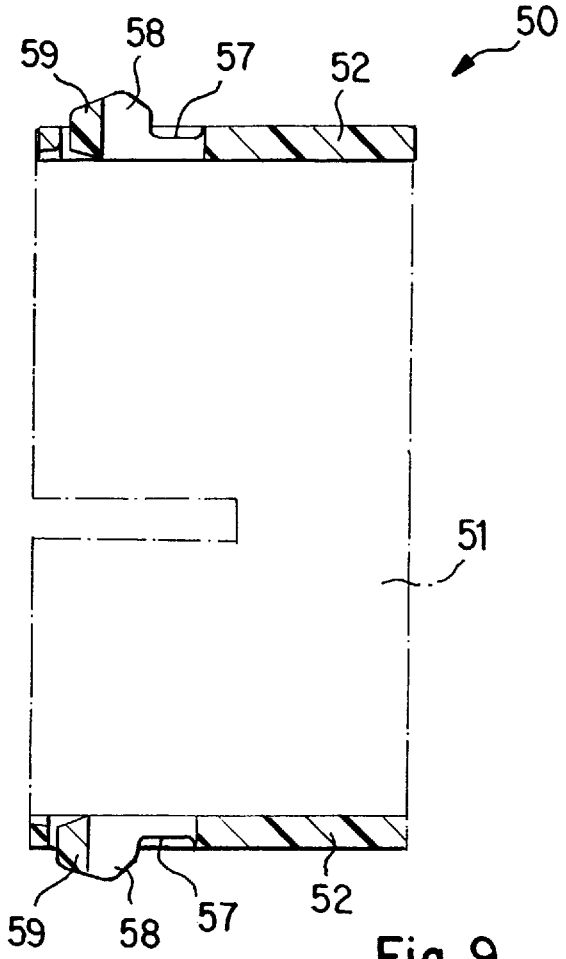
FIG. 9 is a plan cross-sectional view of the short circuit preventing member.
Figure 10:
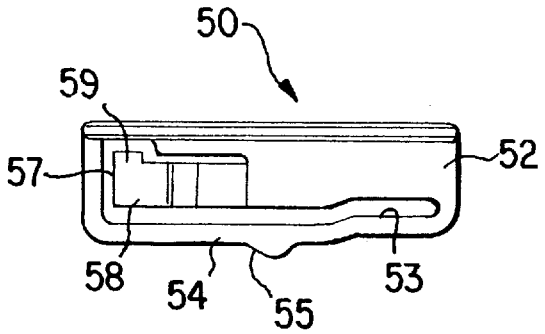
FIG. 10 is a side face view of the short circuit preventing member.

The short circuit preventing member 50, which is shown in FIGS. 8 to 10, is made from insulating plastic, has a cross-sectional U-shape, and is provided with an approximately flat isolating member 51 and a pair of side wall members 52 that protrude downwards from let and right side ends of the isolating member 51. The short circuit preventing member 50 is fitted from the posterior into the member housing hole 21. When located within the member housing hole 21, the isolating member 51 separates the upper and lower cavities 26, and the left and right side wall members 52 are housed within the side grooves 21A. The member housing hole 21 is smaller in dimension, in the up-down direction, than the base plate insertion holes 14A and 14B. Further, the isolating member 51 of the short circuit preventing member 50 is slightly thinner than the base plates 61A and 61B. Moreover, in the anterior-posterior direction, the short circuit preventing member 50 is shorter than the member housing hole 21, the short circuit preventing member 50 being capable of sliding in the anterior-posterior direction therein.

When within the member housing 21, the short circuit preventing member 50 can be located in a short circuit preventing position (shown in FIGS. 1, 2, 5, etc.), whereby the short circuit preventing member 50 is located at the anterior end of the member housing hole 21, or a retreated position (shown in FIGS. 16, 17 and 18), whereby the short circuit preventing member 50 is located at the posterior end of the member housing hole 21. In the short circuit preventing position, the isolating member 51 is located within the base plate insertion holes 14A and 14B, between the resilient contacts 42 of the upper and lower terminal fittings 40, thereby preventing these terminal fittings 40 from short circuiting. In this position, an anterior face wall 24 of the housing 11 prevents the short circuit preventing member 50 from moving towards the anterior. In the retreated position, the isolating member 51 is located to the posterior relative to the resilient contacts 42 of the upper and lower terminal fittings 40, in a position removed therefrom.

Figure 2:
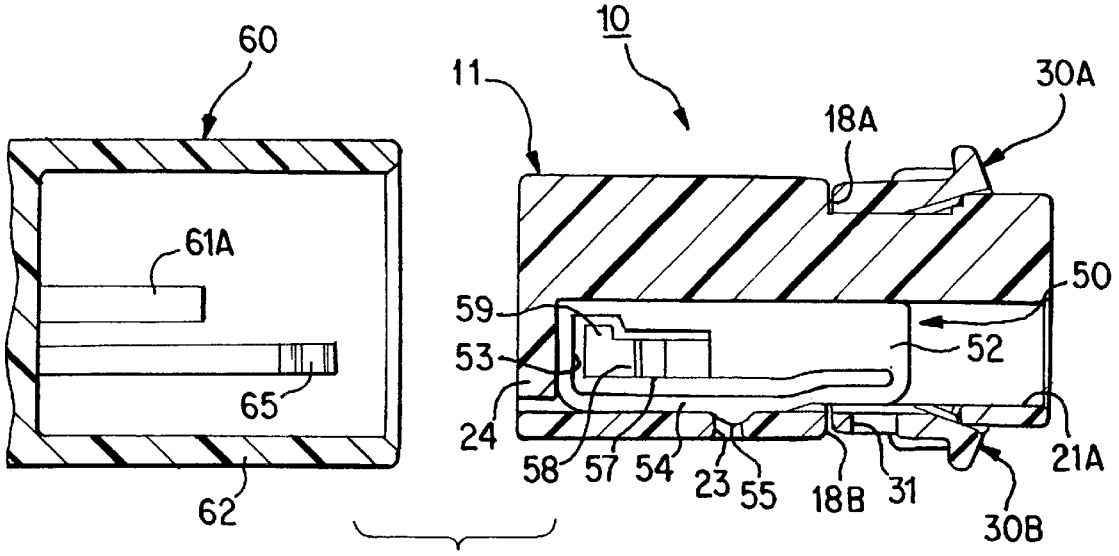
FIG. 2 is another side cross-sectional view showing the card edge connector prior to being fitted together.
Figure 5:
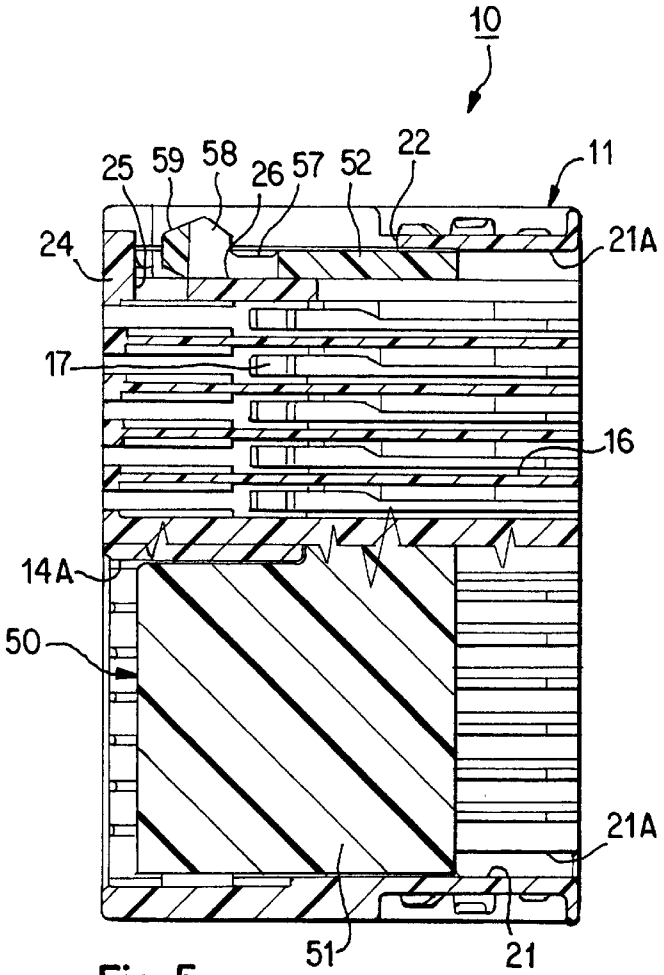
FIG. 5 is a plan cross-sectional view of a housing and a short circuit preventing member.
Figure 3:
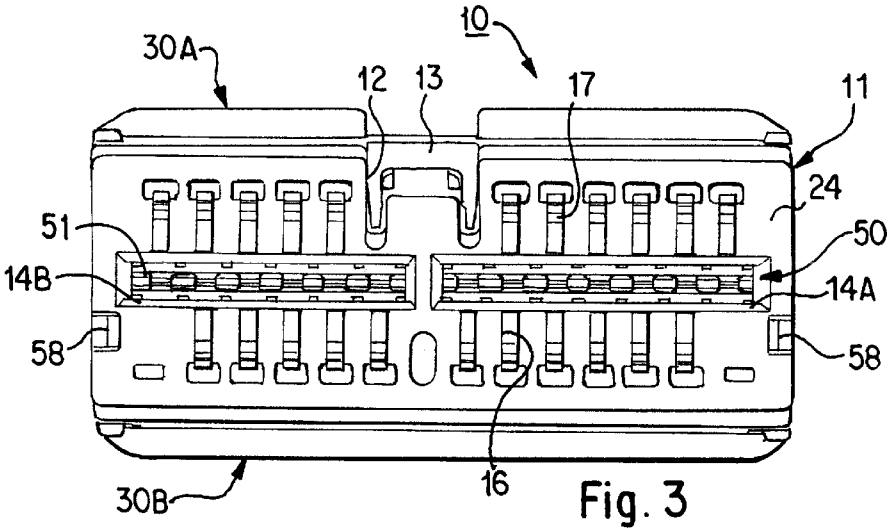
FIG. 3 is a front view of the card edge connector.

As shown in FIG. 10, the side wall members 52 of the short circuit preventing member 50 have cut-away grooves 53 formed therein, these extending in an anterior-posterior direction from locations near the lower ends thereof. The provision of these cut-away grooves 53 results in bending edges 54 being formed in the lower edges of the side wall members 52, central portions of these bending edges 54 being capable of bending in an up-down direction. A position fixing protrusion 55 protrudes downwards from a central portion of each bending edge 54. As shown in FIG. 2, position fixing holes 23 are formed in base faces of the side grooves 21A of the member housing hole 21. The position fixing protrusions 55 engage with these position fixing holes 23, thereby maintaining the short circuit preventing member 50 in the short circuit preventing position. Further, position fixing holes 31 are formed in the lower retainer 30B which is attached at a location to the posterior of the position fixing holes 23. These position fixing holes 31 are provided at locations corresponding to the vase faces of the side grooves 21A, the position fixing protrusions 55 being capable of engaging with these position fixing holes 31. When the position fixing protrusions 55 engage with the position fixing holes 31, the short circuit preventing member 50 is maintained in the retreated position.

An anterior end of each cut-away grooves 53 of the side wall members 52 extends upwards and then towards the posterior towards the vicinity of the central portion thereof. A portion of each side wall member 52 which is surrounded by the cut-away groove 53 forms a retaining arm 57 (this corresponds to the retaining means of the present invention) that extends towards the anterior. These retaining arms 57 are capable of bending in the widthwise direction of the short circuit preventing member 50. A retaining protrusion 58 is formed on a tip of each retaining arm 57, this protruding outwards relative to the widthwise direction. When the retaining arms 57 are in a natural, unbent, state (see FIG. 5), the retaining protrusions 58 protrude outwards from the window holes 22 of the housing 11. A bending regulating protrusion 59 protrudes upwards from a tip of each retaining protrusion 58.

Figure 11:
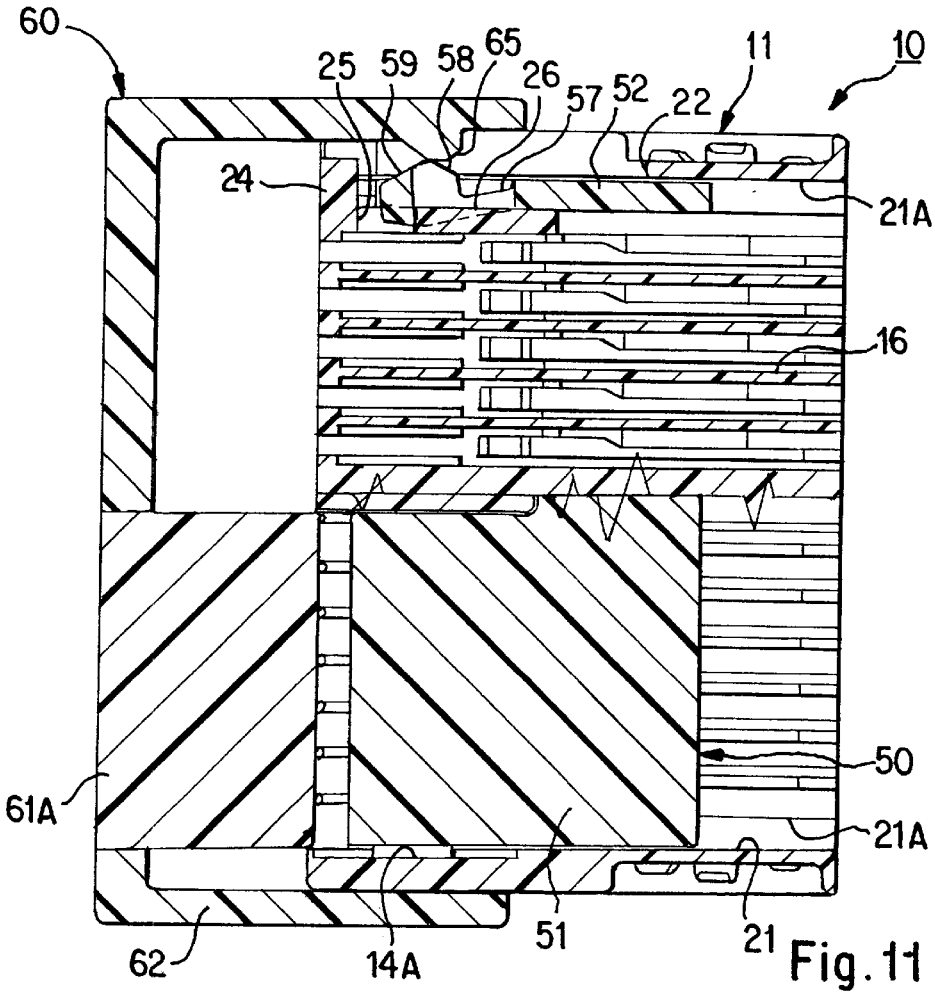
FIG. 11 is a plan cross-sectional view showing a state whereby retaining arms have been bent by returning protrusions.
Figure 15:
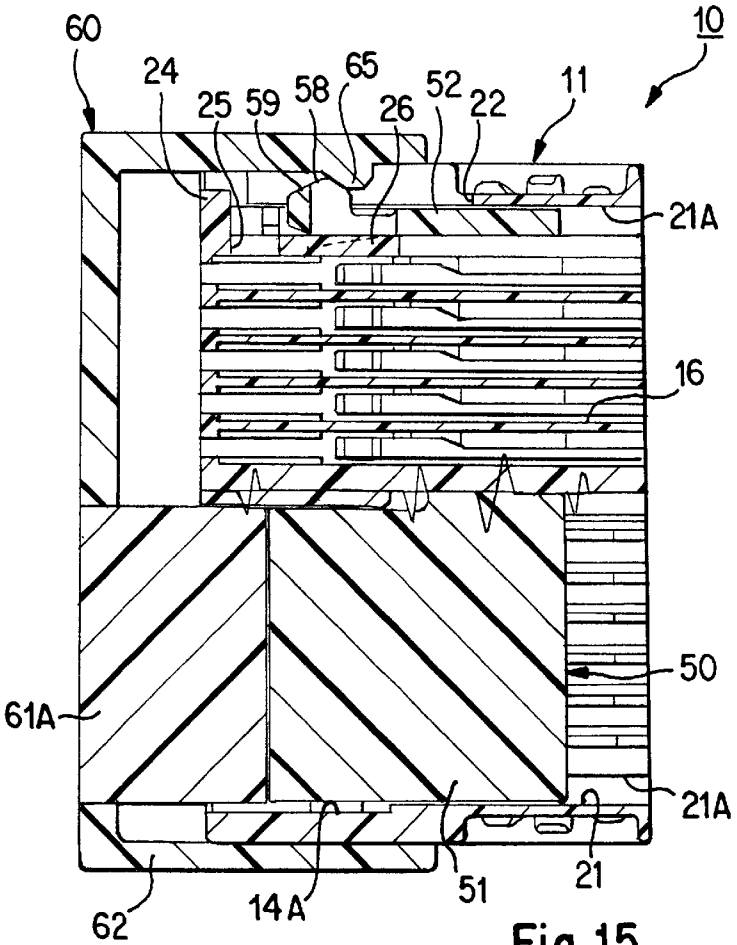
FIG. 15 is a plan cross-sectional view showing the short circuit preventing member being moved between the short circuit preventing position and the retreated position.

As shown in FIG. 11, recesses 25 are formed in a concave manner in inner side faces, relative to the widthwise direction, of the side grooves 21A of the housing 11. These recesses 25 allow the retaining arms 57 to bend. As shown in FIG. 15, long and narrow bending regulating walls 26 extend in an anterior-posterior direction along inner side walls (relative to the widthwise direction) of the side grooves 21A. These bending regulating walls 26 make contact with inner sides, relative to the widthwise direction, of the bending regulating protrusions 59, thereby controlling the bending of the retaining arms 57. The recesses 25 are provided at the anterior ends of the bending regulating walls 26. When the short circuit preventing member 50 is located to the posterior (relative to the short circuit preventing position), the retaining arms 57 are in a state whereby they cannot be bent. When the short circuit preventing member 50 is in the short circuit preventing position (see FIG. 5), the bending regulating protrusions 59 are located to the anterior of the bending regulating walls 26, thereby allowing the retaining arms 57 to bend.

Figure 7:
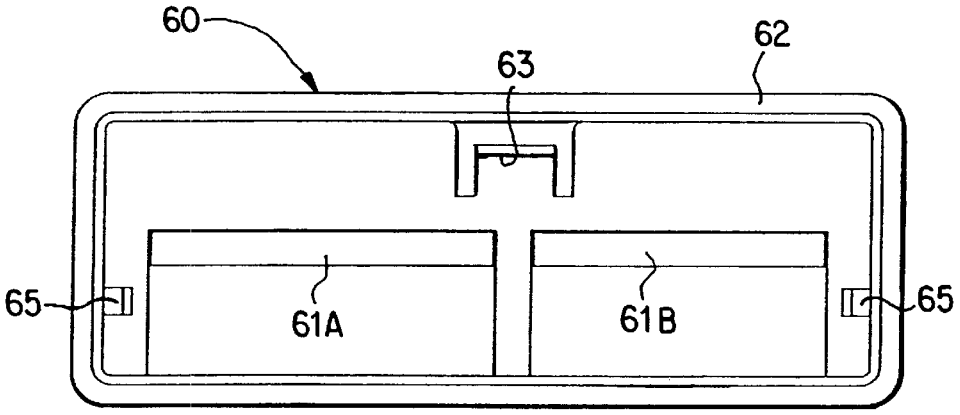
FIG. 7 is a front view of a corresponding connector.
Figure 13:
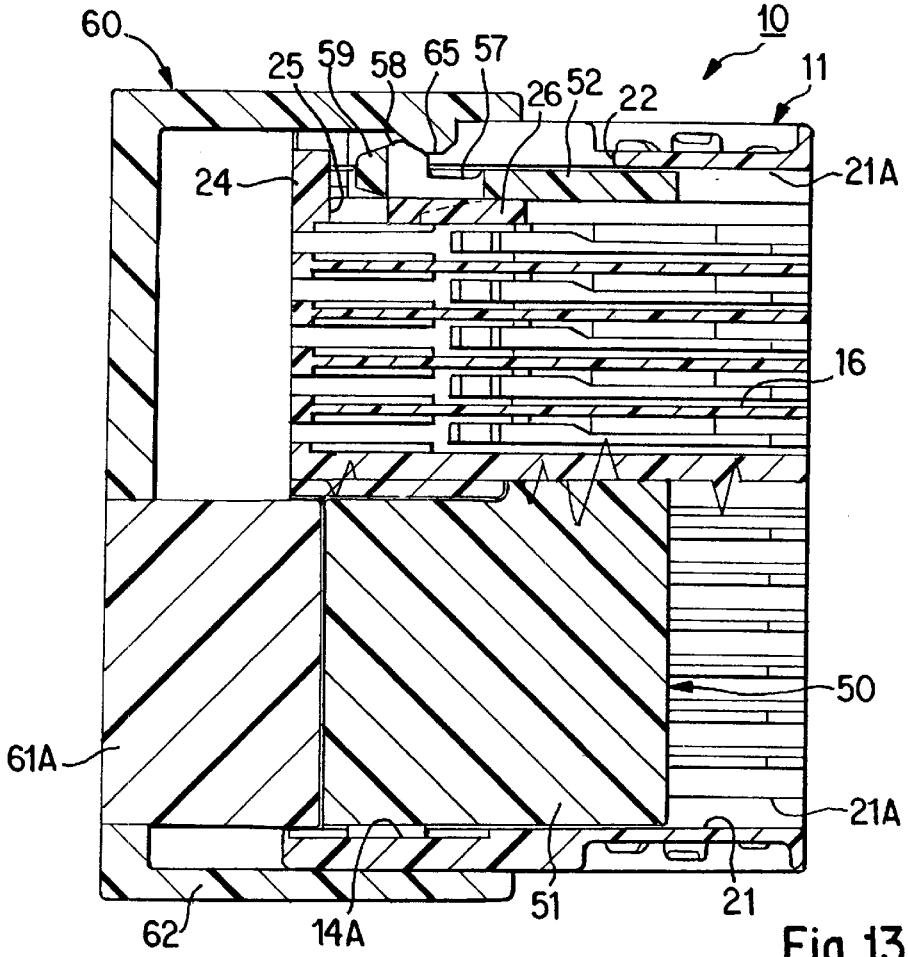
FIG. 13 is a plan cross-sectional view showing the short circuit preventing member in the short circuit preventing position.

As shown in FIGS. 7 and 13, a pair of returning protrusions 65 are formed on left and right inner side faces of the hood 62 of the corresponding housing 60. When the two housings 11 and 60 have been fitted together, these returning protrusions 65 engage, from the posterior, with the retaining protrusions 58.

The present embodiment is configures as described above. Next, the operation thereof will be described.

When the two housings 11 and 60 are in a state prior to being fitted together (see FIGS. 1 and 2), the short circuit preventing member 50 is located between the upper and lower resilient contacts 42, the contacting members 42A of these resilient contacts 42 making resilient contact with the short circuit preventing member 50. By this means, the terminal fittings 40, which are located in mutually corresponding positions above and below, are prevented from short circuiting.

When the two housings 11 and 60 are fitted together from this state, the housing 11 is fitted into the corresponding hood 62. At this juncture, the returning protrusions 65 strike against the bending regulating protrusions 59 (see FIG. 11), bending the retaining arms 57 into the recesses 25. Moreover, tips of the base plates 61A and 61B are inserted into the base plate insertion holes 14A and 14B respectively.

Figure 12:
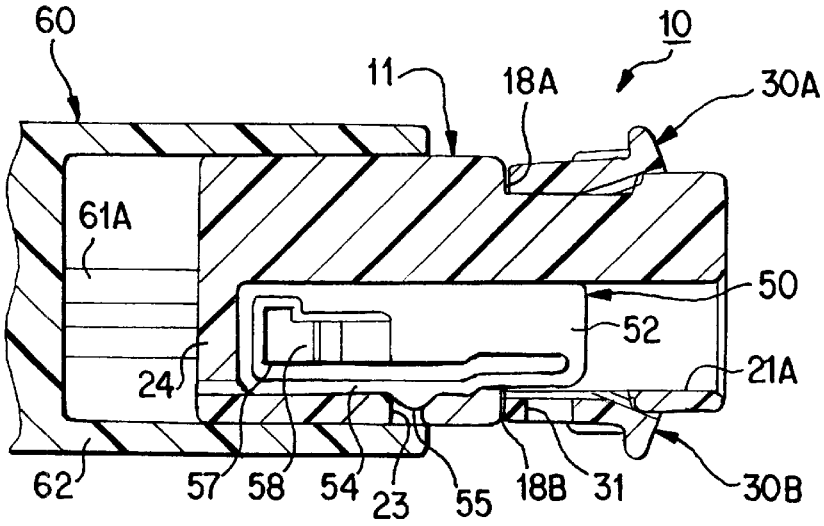
FIG. 12 is a side cross-sectional view showing the short circuit preventing member in a short circuit preventing position.

As fitting progresses, the returning protrusions 65 rise over the bending regulating protrusions 59, the retaining arms 57 returning to their original shape and being released from the recesses 25 (the state shown in FIGS. 12 and 13). By this means, the returning protrusions 65 engage from the posterior with the retaining protrusions 58. Simultaneously, tip ends of the base plates 61A and 61B strike against an anterior end of the short circuit preventing member 50.

Figure 14:
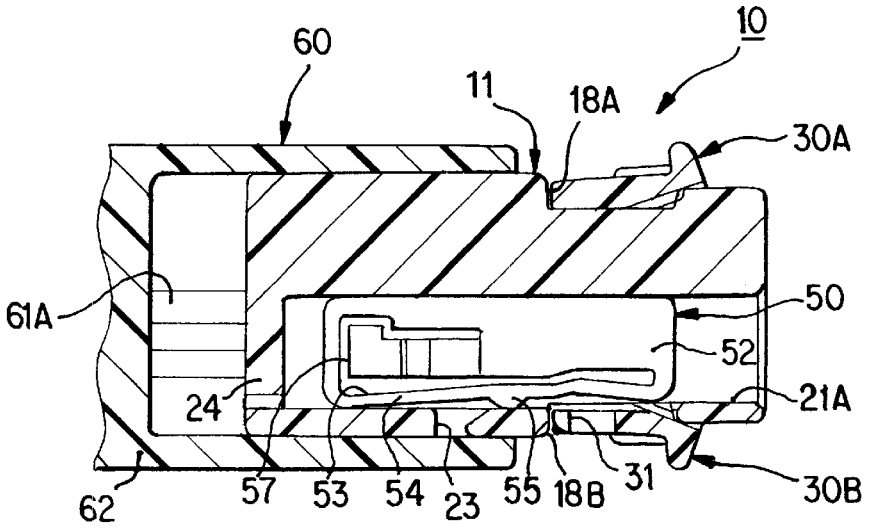
FIG. 14 is a side cross-sectional view showing the short circuit preventing member being moved between the short circuit preventing position and a retreated position.

As fitting progresses further, the short circuit preventing member 50 is pushed towards the posterior by the base plates 61A and 61B while these base plates 61A and 61B are being inserted into the base plate insertion holes 14A and 14B (this state is shown in FIGS. 14 and 15). Then, the central portions of the bending edges 54 of the side wall members 52 of the short circuit preventing member 50 bend upwards, and the position fixing protrusions 55 rise over the base faces of the side grooves 21A. In this state, the short circuit preventing member 50 is moved into the retreated position.

Next, the short circuit preventing member 50 is removed from between the resilient contacts 42 of the upper and lower terminal fittings 40. The tip ends of the base plates 61A and 6'1B make contact with the upper and lower resilient contacts 42, enter therebetween and bend these resilient contacts 42 in a direction of mutual separation. The base plates 61A and 61B are now resiliently gripped between the contacting members 42A of the upper and lower resilient contacts 42.

Figure 16:
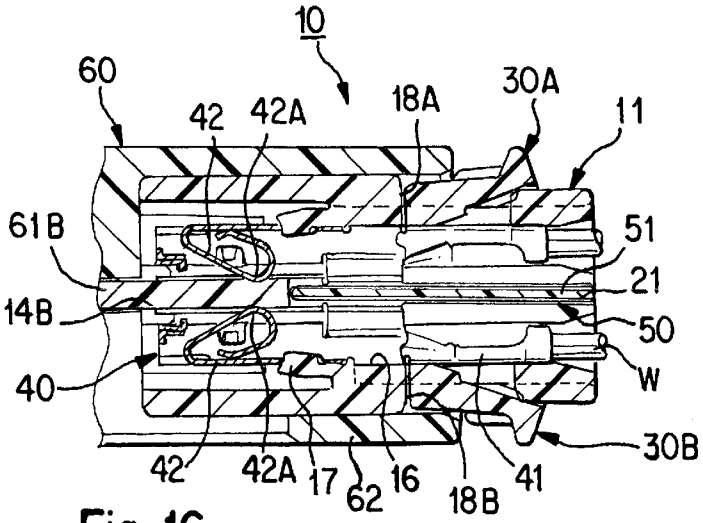
FIG. 16 is a side cross-sectional view showing a correctly fitted state.
Figure 17:
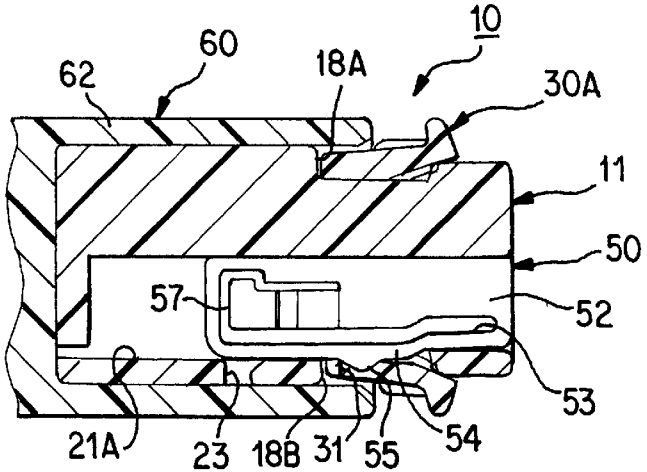
FIG. 17 is a side cross-sectional view showing the correctly fitted state.
Figure 18:
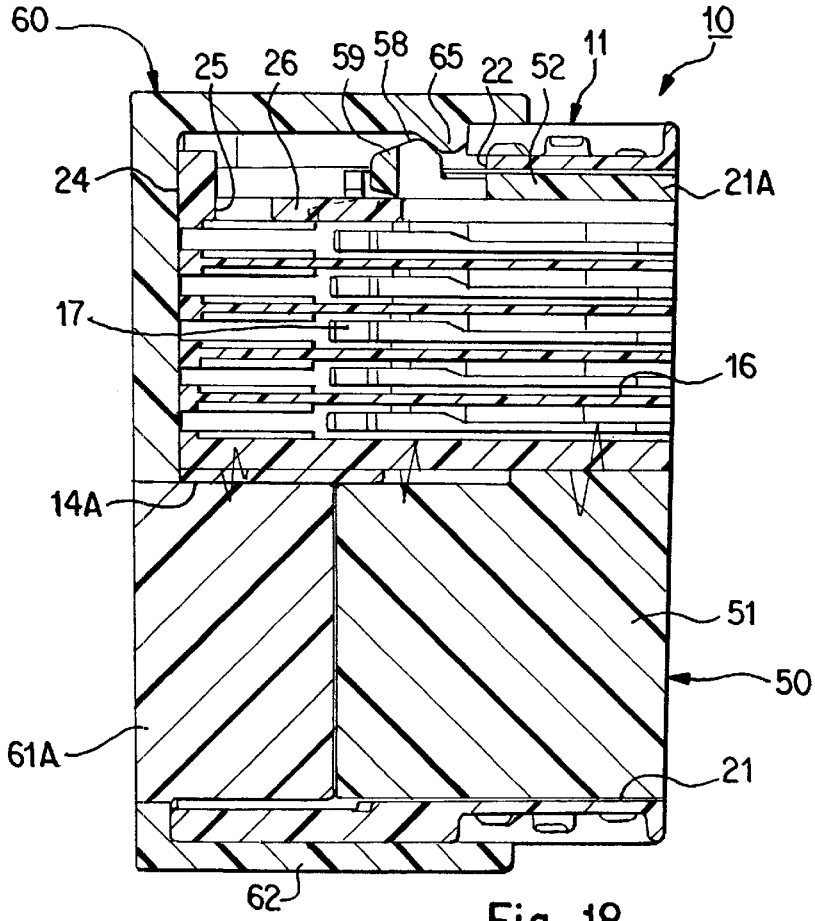
FIG. 18 is a plan cross-sectional view showing the correctly fitted state.

When the two housings 11 and 60 have been fitted together in a correct position, the locking arm 13 engages with the lock receiving member 63, this locking the two housings 11 and 60 in a fitted state (the state shown in FIGS. 16 to 18). Furthermore, the bending edges 54 of the side wall members 52 of the short circuit preventing member 50 return to their original position, and the position fixing protrusions 55 of the short circuit preventing member 50 fit into and are engaged with the position fixing holes 31 of the lower retainer 30B, this maintaining the short circuit preventing member 50 in the retreated position. Further, the base plates 61A and 61B are resiliently gripped between the contacting members 42A of the upper and lower resilient contacts 42, these contacting members 42A making contact with the terminals provided on both faces of the base plates 61A and 61B, and each circuit (not shown) contact. In this manner, the fitting operation of the two housings 11 and 60 is completed.

In the case where the two housings 11 and 60 are to be separated from a fitted state, the locking arm 13 is first pushed downwards, this releasing is from its engagement with the lock receiving member 63. Then, from this state, the two housings 11 and 60 are pulled in a direction of mutual separation. As this is done, the base plates 61A and 61B leave the base plate insertion holes 14A and 14B, and the returning protrusions 65 push the retaining protrusions 58 in a direction of separation. At this juncture, the bending regulating walls 26 make contact with the inner sides, relative to the widthwise direction thereof, of the bending regulating protrusions 59, thereby preventing the retaining arms 57 from bending. Consequently, the returning protrusions 65 and the retaining protrusions 58 are maintained in their engages state. As a result, the short circuit preventing member 50 moves towards the anterior while the base plates 61A and 61B are being removed from the base plate insertion holes 14A and 14B (see FIGS. 14 and 15). Furthermore, the central portions of the bending edges 54 of the side wall members 52 bend, the position fixing protrusions 55 being removed from the position fixing holes 31 of the lower retainer 30B. The base plates 61A and 61B and the short circuit preventing member 50 are moved while their tips are in a mutually contacting state. When the base plates 61A and 61B are removed from between the resilient contacts 42 of the upper and lower terminal fittings 40, these upper and lower resilient contacts 42 move slightly towards one another, then make resilient contact with the short circuit preventing member 50.

When the short circuit preventing member 50 reaches the short circuit preventing position, it makes contact with the anterior face wall 24 of the housing 11. This prevents the short circuit preventing member 50 from moving towards the anterior.

Furthermore, the position fixing protrusions 55 are engaged with the position fixing holes 23, thereby maintaining the position of the short circuit preventing member 50 (the state shown in FIGS. 12 and 13). At this juncture, the bending regulating protrusions 59 are located to the anterior of the bending regulating walls 26, in a location whereby they do not interfere therewith.

When the two housings 11 and 60 are separated further, the returning protrusions 65 push the bending regulating protrusions 59 (see FIG. 11), the retaining arms 57 are moved into the recesses 25, and the returning protrusions 65 are released from the retaining protrusions 58.

Then, the base plates 61A and 61B are removed from the base plate insertion holes 14A and 14B, the retaining protrusions 58 rise over the returning protrusions 65 and the retaining arms 57 return to their original position. Thereupon, the housing 11 is removed from the hood 62, and the two housings 11 and 60 return to their state prior to being fitted together (see FIGS. 1, 2 and 5).

In this manner, the card edge connector 10 of the present embodiment has the short circuit preventing member 50 located between the resilient contacts 42 of the mutually opposing upper and lower terminal fittings 40, this preventing the terminal fittings 40 from short circuiting. As a result, the resilient contacts 42 can be caused to bend to a greater degree, thus increasing their contacting force with the base plates 16A and 61B.

Furthermore, the short circuit preventing member 50 is moved from the short circuit preventing position to the retreated position as the base plates 61A and 61B are being pushed in (while the two housings 11 and 60 are being fitted together). Operability is thereby simplified. In particular, since the base plates 61A and 61B push the short circuit preventing member 50 directly, no other components need be provided to perform this pushing operation.

Moreover, the short circuit preventing member 50 returns from the retreated position to the short circuit preventing position, so as to prevent the terminal fittings 40 from short circuiting, as the base plates 61A and 61B are being removed (while the two housings 11 and 60 are being separated.) Operability is thereby simplified.

The short circuit preventing member 50 is thinner than the base plates 61A and 61B. Consequently, the resilient contacts 42 bend only a little when they make contact with the short circuit preventing member 50. This prevents fatigue of the resilient contacts 42 in the case where the short circuit preventing member 50 is left in the retreated position for a long period.

If resilient contacts are bent to a great degree, the resisting force increases when base plates are inserted. However, in the card edge connector 10 described above, the base plates 61A and 61B and the short circuit preventing member 50 are maintained in a contacting state while the two housings 11 and 60 are fitted together, the base plates 61A and 61B entering between the upper and lower resilient contacts 42 and taking the place of the short circuit preventing member 50. That is, the resilient contacts 42 move without interruption from a state whereby they are bent as a result of making contact with the short circuit preventing member 50, to a state whereby they are bent more as a result of making contact with the base plates 61A and 61B. Consequently, compared to the case where base plates are inserted between resilient contacts which are in a natural, unbent, state, the resilient contacts of the present embodiments are bent to a lesser degree when the base plates are inserted. Consequently, less resisting force occurs during insertion.

A second embodiment of the present invention is described below with the aid of FIGS. 19 to 27. In the following description, configurations which are the same as in the first embodiment are accorded the same symbols and an explanation thereof is omitted.

Figure 19:
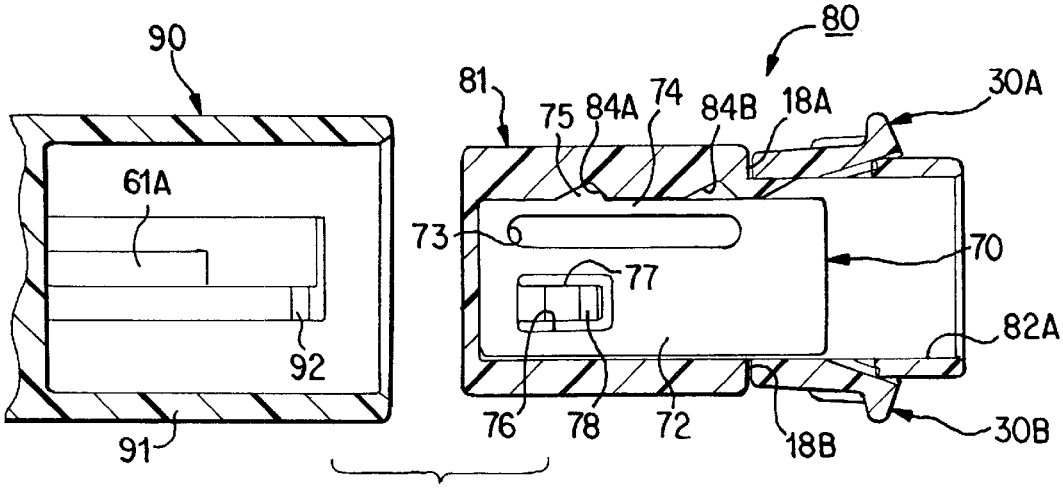
FIG. 19 is a side cross-sectional view of a card edge connector of a second embodiment prior to being fitted together.
Figure 20:
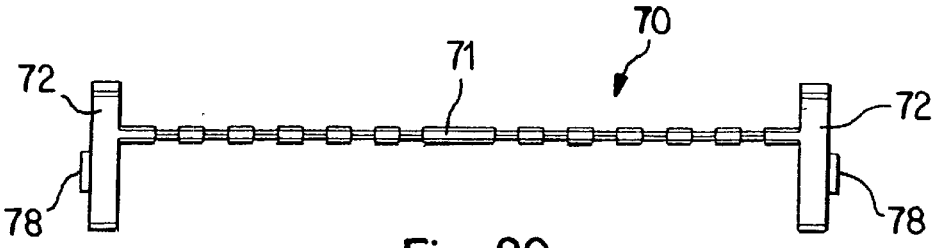
FIG. 20 is a front view of a short circuit preventing member.

As shown in FIG. 20, a short circuit preventing member 70 of a card edge connector 80 of the present embodiment is cross-sectionally H-shaped. This short circuit preventing member 70 is provided with an approximately flat isolating member 71 and a pair of side wall members 72 that protrude upwards and downwards from left and right side ends of the isolating member 71. The isolating member 71 is slightly thinner than the base plates 61A and 61B. As shown in FIG. 19, upper portions of the side wall members 72 have cut-away grooves 73 formed therein, these extending in an anterior-posterior direction. The provision of these cut-away grooves 73 results in bending edges 74 being formed in upper edges of the side wall members 52, central portions of these bending edges 74 being capable of bending in an up-down direction. A position fixing protrusion 75 protrudes upwards from a central portion of each bending edge 74.

Figure 21:
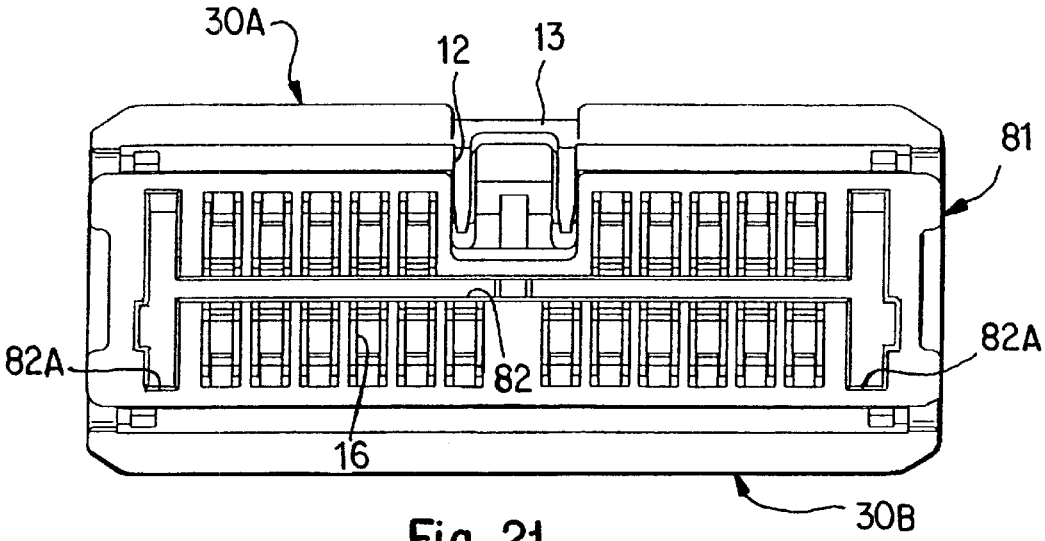
FIG. 21 is a rear face view of a housing.
Figure 22:
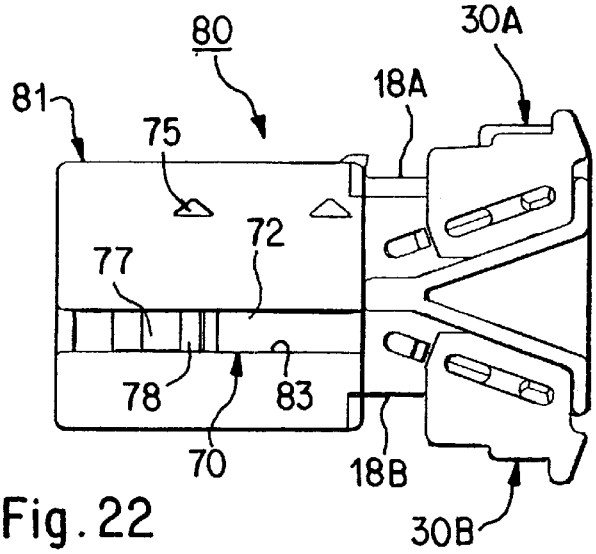
FIG. 22 is a side face view of the card edge connector.

A member housing hole 82, which is cross-sectionally H-shaped so as to correspond to the short circuit preventing member 70, is provided in the housing 81 (see FIG. 21). This member housing hole 82 is capable of housing the short circuit preventing member 70. As in the first embodiment, the short circuit preventing member 70 can be slid between a short circuit preventing position and a retreated position within the member housing hole 82. Left and right side ends of the member housing hole 82 form side grooves 82A. As shown in FIG. 22, window holes 83 pass through left and right side faces of the housing 81, these adjoining portions of the side grooves 82A. Furthermore, as shown in FIG. 19, a pair of position fixing holes 84A and 84B are formed in an anterior-posterior direction in upper faces of the side grooves 82A. The position fixing protrusions 75 engage with either the position fixing hole 84A or the position fixing hole 84B, thereby maintaining the short circuit preventing member 70 in position.

A U-shaped cut-away member 76 is formed in an anterior lower portion of each side wall member 72 of the short circuit preventing member 70. A portion of each side wall member 72 which is surrounded by this cut-away member 76 forms a retaining arm 77 (this corresponds to the retaining means of the present invention) that extends from the anterior towards the posterior. These retaining arms 77 are capable of bending in the widthwise direction of the short circuit preventing member 70. A retaining protrusion 78 if formed on a posterior end (a free end) of each retaining arm 77, this protruding outwards relative to the widthwise direction. When the retaining arms 77 are in a natural, unbent, state (see FIG. 23), the retaining protrusions 78 protrude outwards from the window holes 83 of the housing 81. Recessed members 85 are formed in a concave manner in inner side faces, relative to the widthwise direction, of the side grooves 82A of the housing 81. These recessed members 85 allow the retaining arms 77 to bend. Side faces located to the posterior of the recessed members 85 form bending regulating walls 86, these making contact with inner sides, relative to the widthwise direction, of the retaining arms 77 and thereby controlling their bending.

Figure 24:
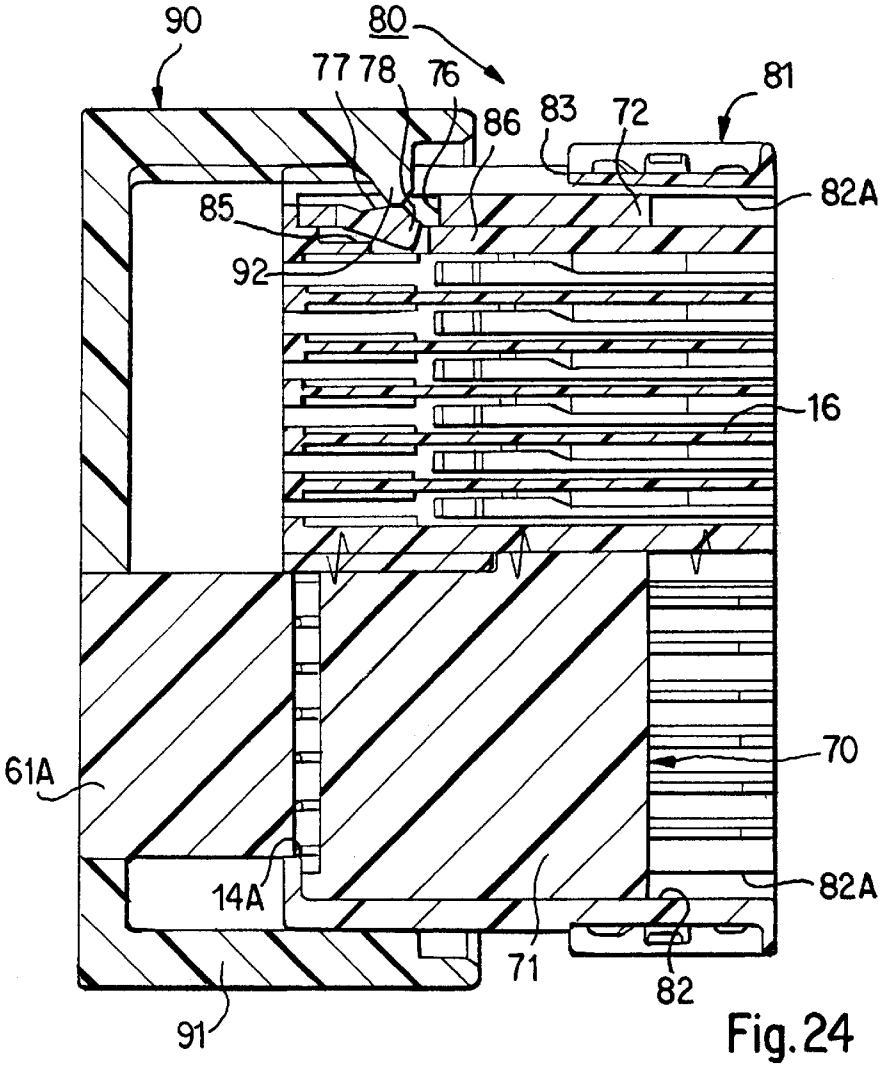
FIG. 24 is a plan cross-sectional view showing a state whereby retaining arms have been bent by returning protrusions.
Figure 23:
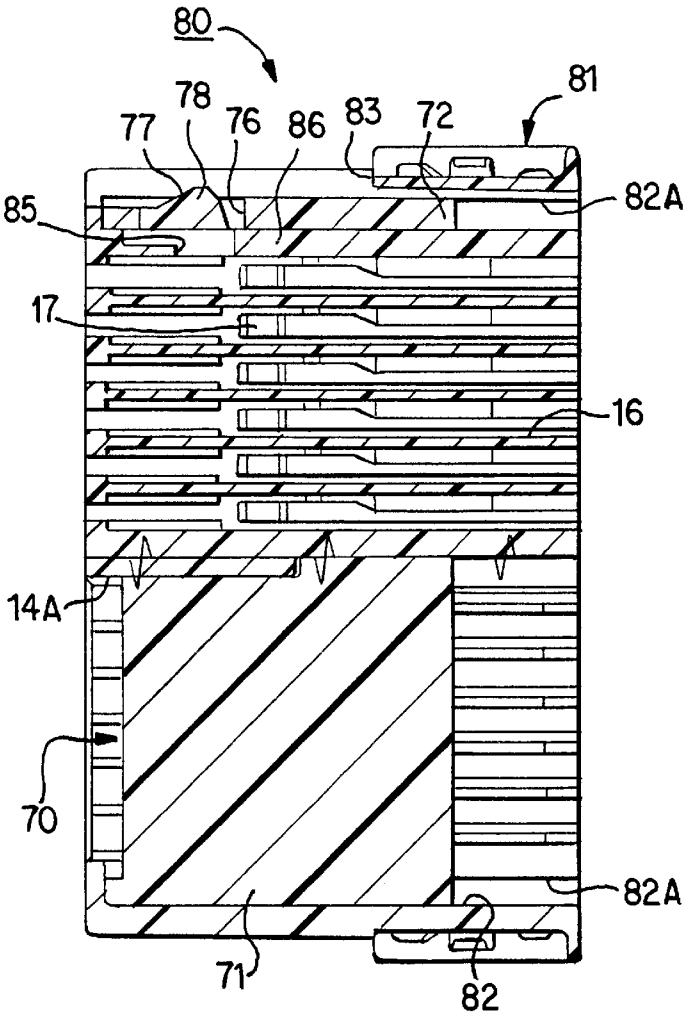
FIG. 23 is a plan cross-sectional view of the housing and the short circuit preventing member.

As shown in FIGS. 19 and 24, a pair of returning protrusions 92 are formed on left and right inner side faces of a hood 91 of a corresponding housing 90. When the two housings have been fitted together, these returning protrusions 92 engage, from the posterior, with the retaining protrusions 78.

The operation of the present embodiment is described below.

When the two housings 81 and 90 are fitted together from the state shown in FIG. 19, the returning protrusions 92 strike against the retaining protrusions 78 (see FIG. 24), bending the retaining arms 77 into the recessed members 85. Then, the returning protrusions 92 rise over the retaining protrusions 78, the retaining arms 77 return to their original shape, and the returning protrusions 92 engage from the posterior with the retaining protrusions 78. At approximately the same time, the base plates 61A and 61B, which have been inserted into base plate insertion holes 14A and 14B, strike against the short circuit preventing member 70.

As fitting progresses, the base plates 61A and 61B push the short circuit preventing member 70 towards the posterior, the bending edges 74 bend towards the cut-away grooves 73 (see FIG. 25), and the position fixing protrusions 75 rise over upper wall faces of the side grooves 82A. When the two housings 81 and 90 have reached a correctly fitted state, the bending edges 74 return to their original positions, and the position fixing protrusions 75 fit into the posterior position fixing holes 84B, thereby maintaining the short circuit preventing member 70 in a retreated position (see FIGS. 26 and 27).

Figure 25:
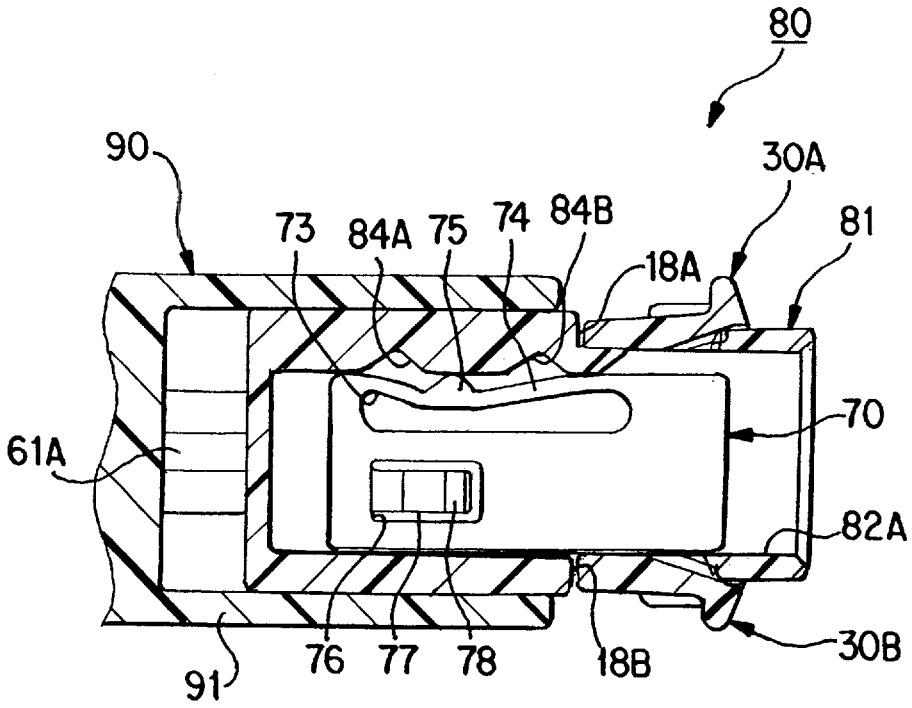
FIG. 25 is a side cross-sectional view showing the short circuit preventing member being moved between a short circuit preventing position and a retreated position.
Figure 26:
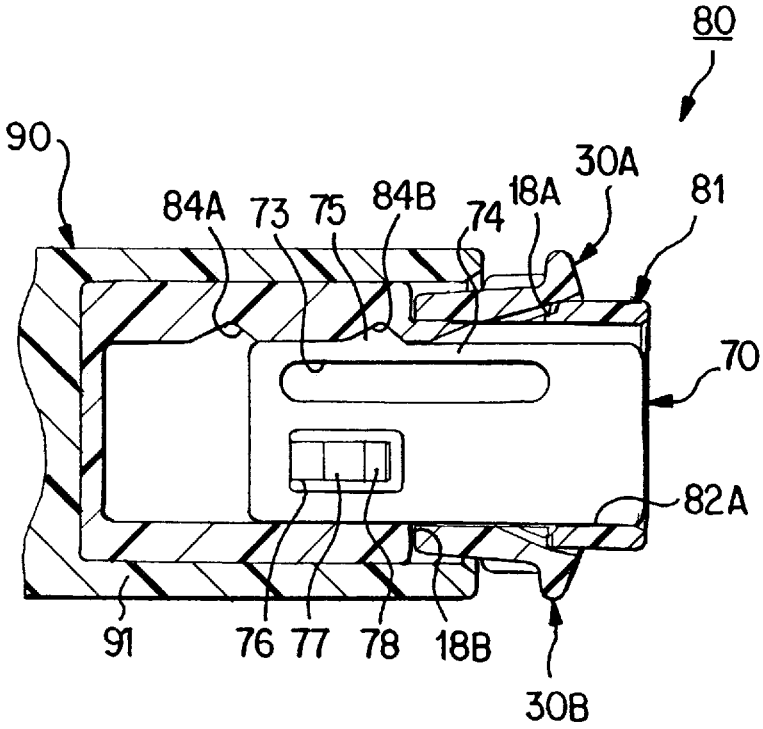
FIG. 26 is a side cross-sectional view showing a correctly fitted state.
Figure 27:
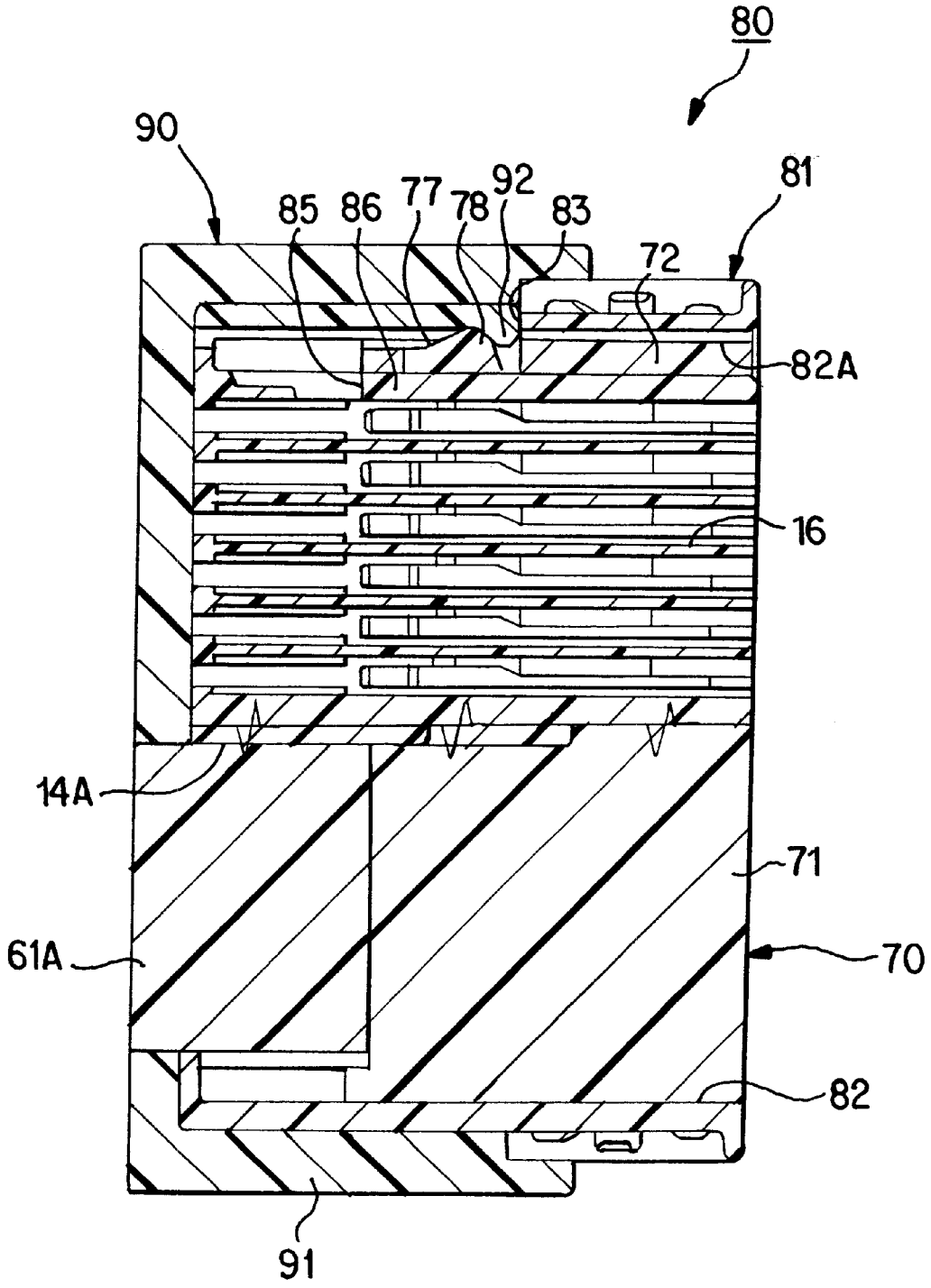
FIG. 27 is a plan cross-sectional view showing the correctly fitted state.
Figure 28:
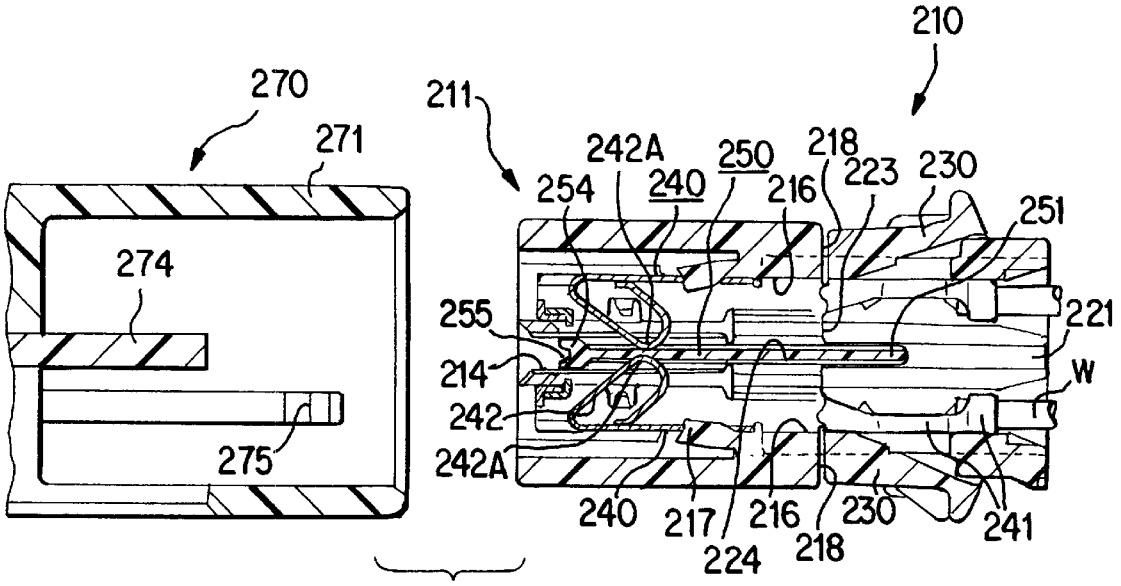
FIG. 28 is a side cross-sectional view of a third embodiment of the present invention prior to being fitted together.
Figure 29:
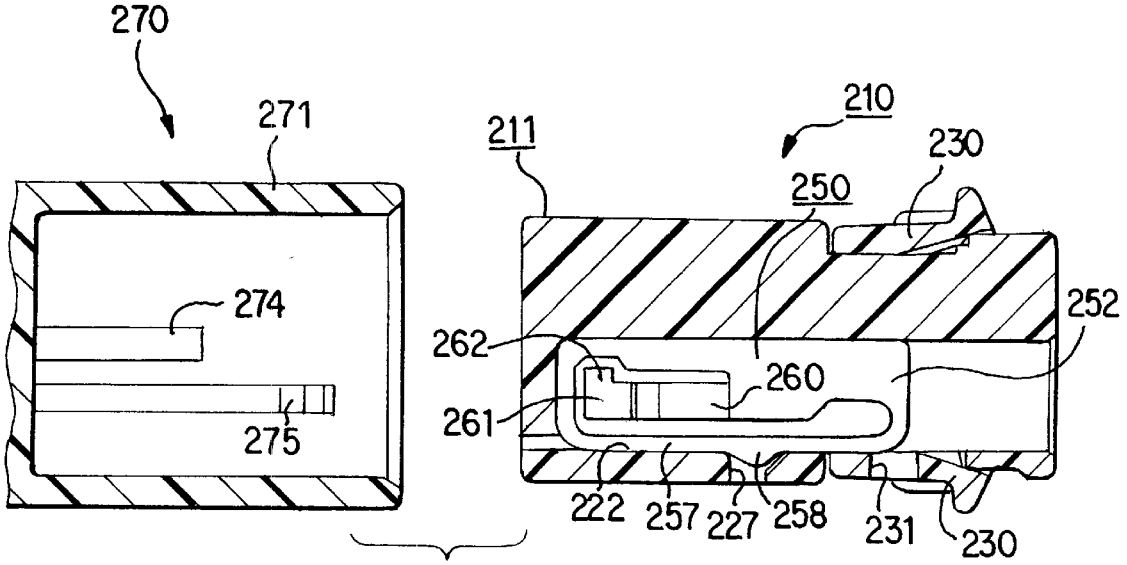
FIG. 29 is a side cross-sectional view showing fixing portions of a short circuit preventing member of the present invention prior to being fitted together.
Figure 32:
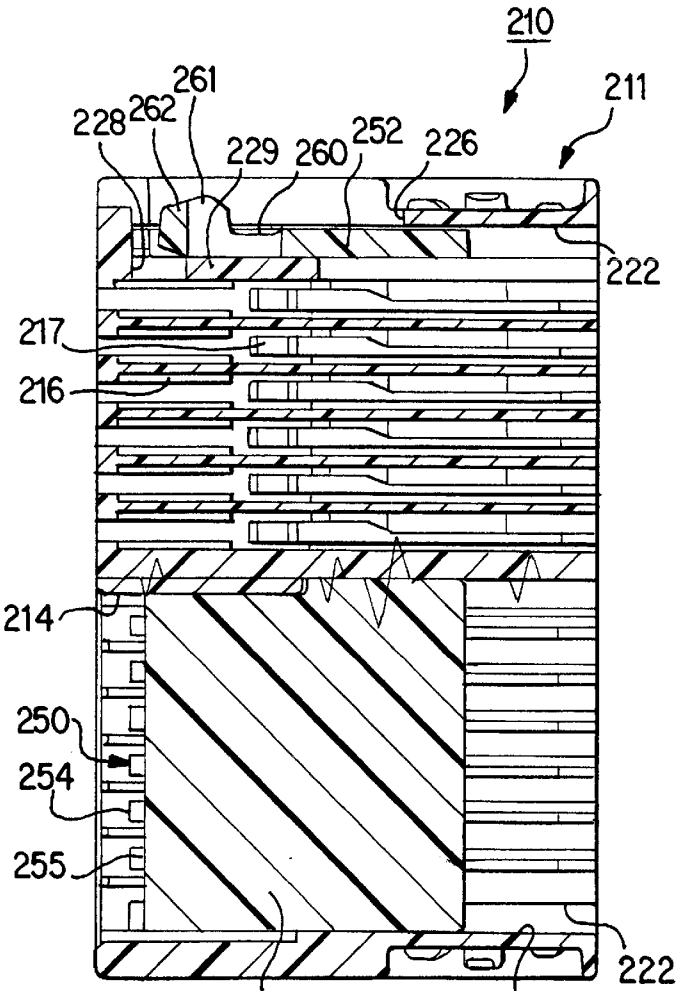
FIG. 32 is a plan cross-sectional view of the housing.
Figure 30:
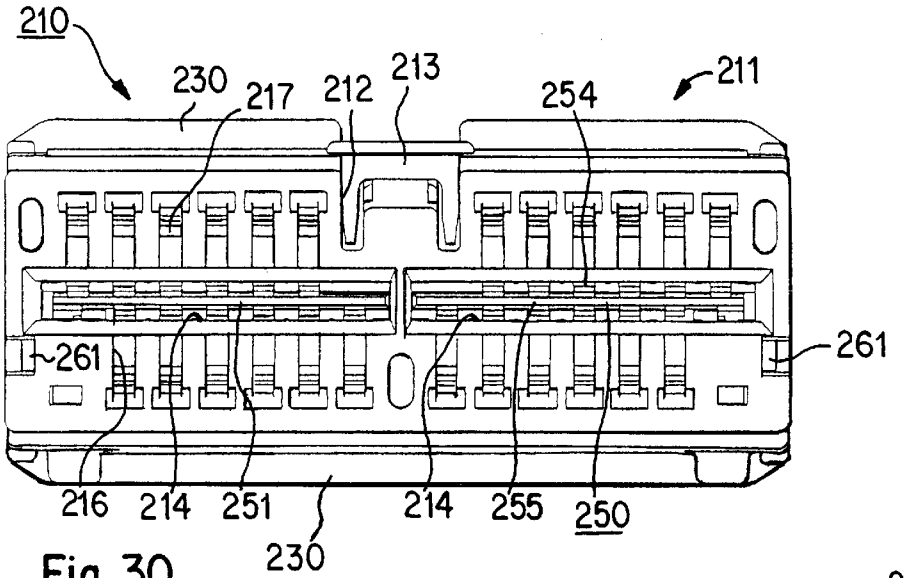
FIG. 30 is a front view of a housing.
Figure 31:
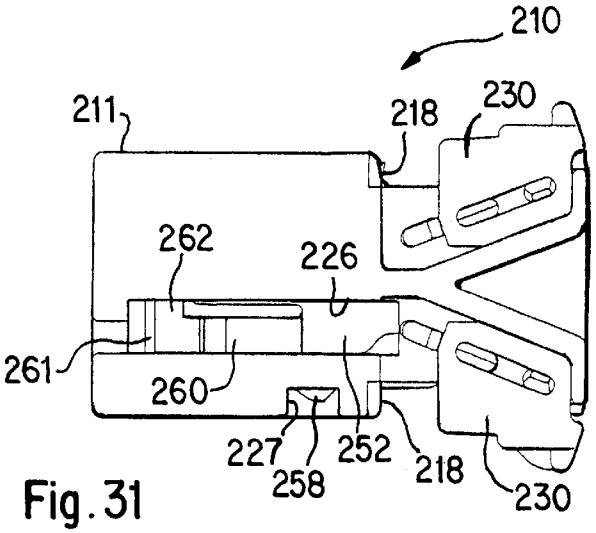
FIG. 31 is a side face view of the housing.
Figure 33:
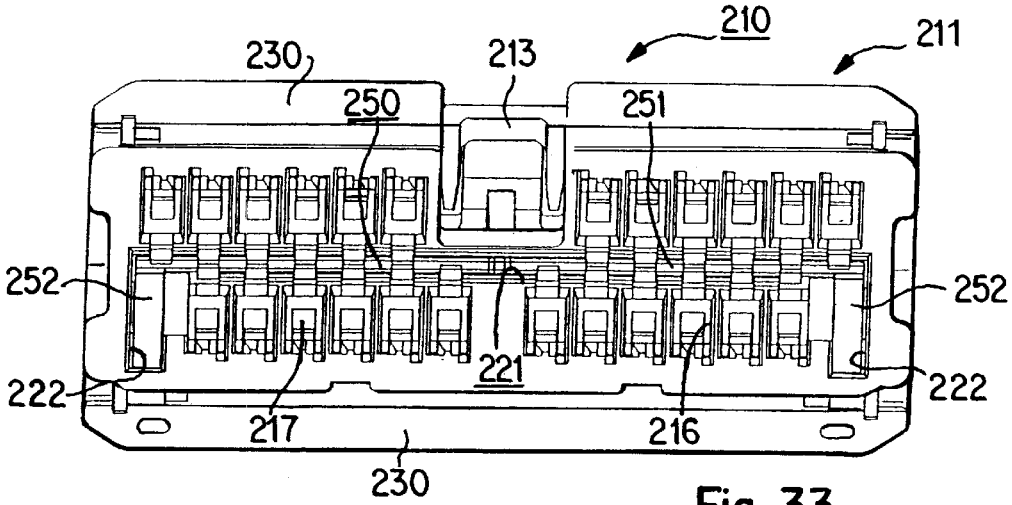
FIG. 33 is a rear face view of the housing.
Figure 34:
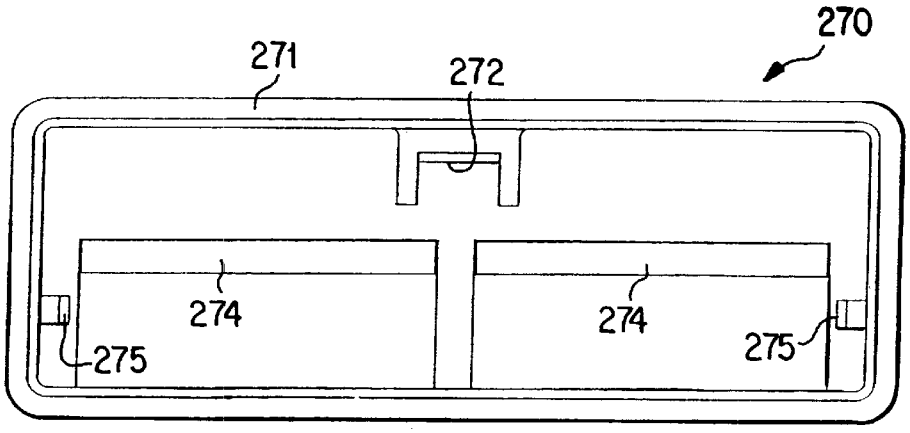
FIG. 34 is a front view of a corresponding housing.
Figure 35:
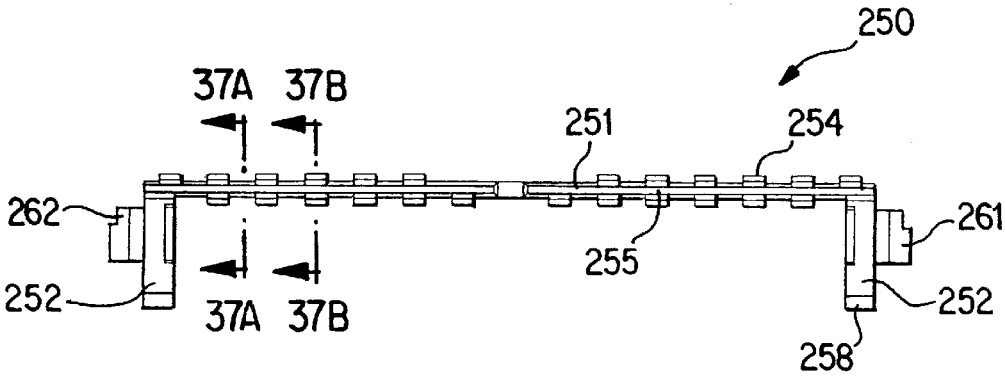
FIG. 35 is a front view of the short circuit preventing member.
Figure 36:
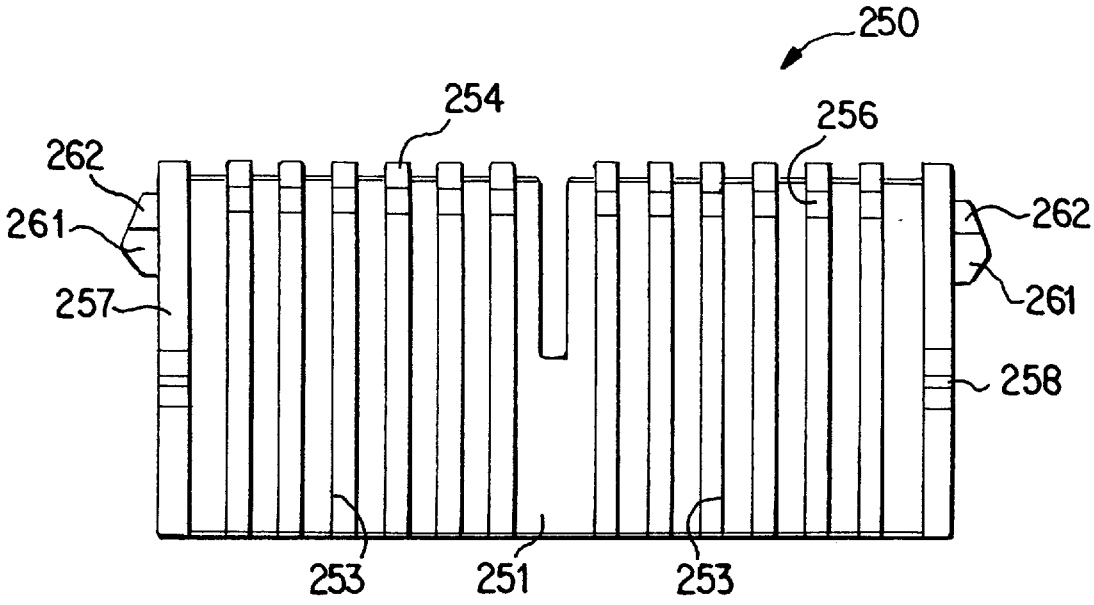
FIG. 36 is a base face view of the short circuit preventing member.
Figure 37A:
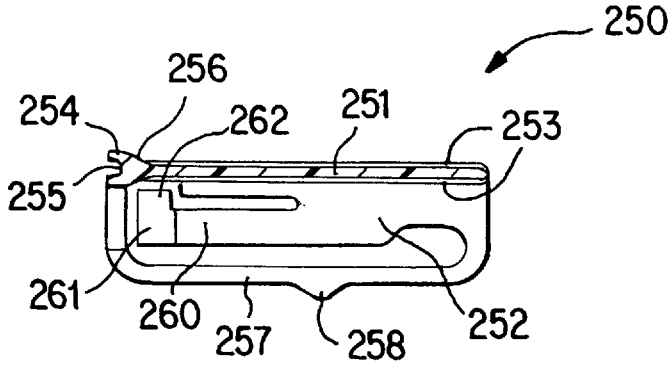
FIG. 37A is a side corss-sectional view along the line A—A of FIG. 8.
Figure 37B:
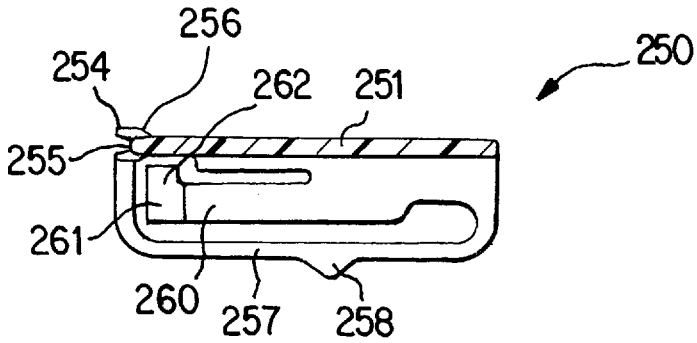
FIG. 37B is a side cross-sectional view along the line B—B of FIG. 8.
Figure 38:
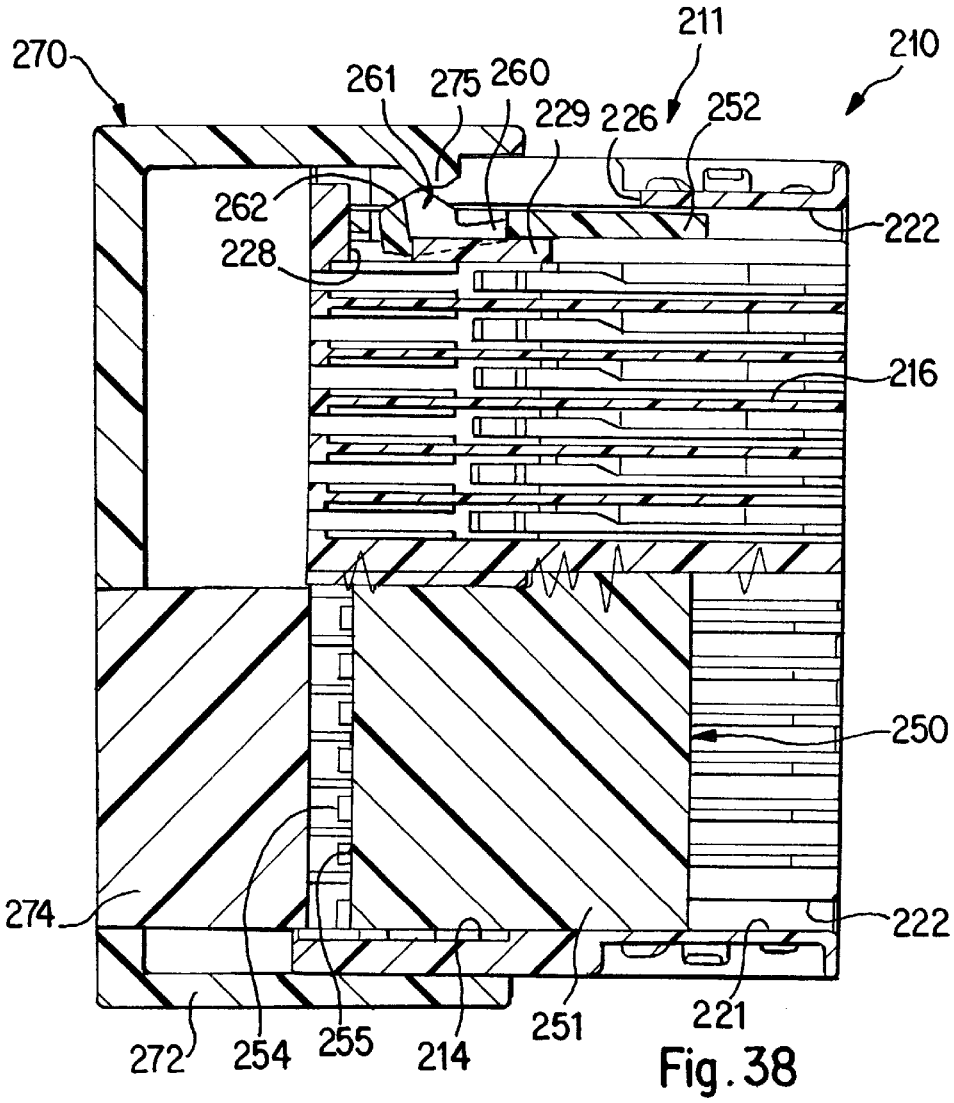
FIG. 38 is a plan cross-sectional view showing a state whereby retaining arms have been bent by returning protrusions.
Figure 39:
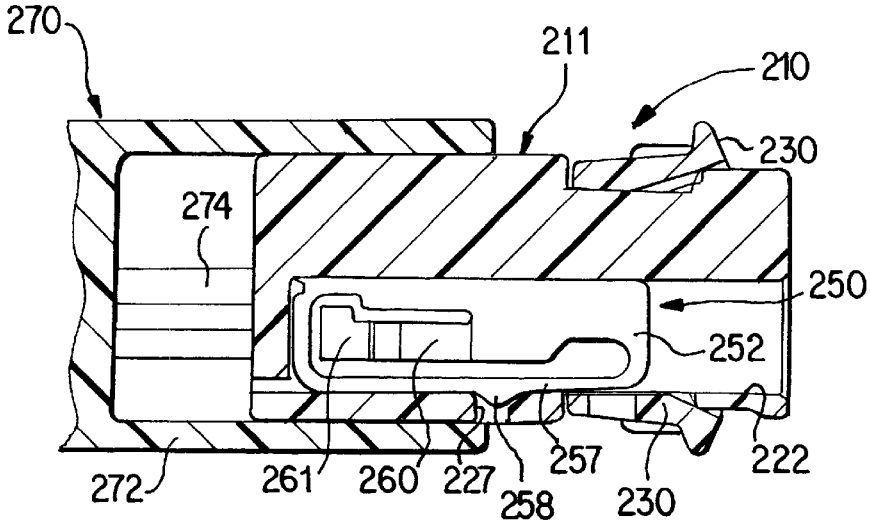
FIG. 39 is a side cross-sectional view showing base plates making contact with the short circuit preventing member.
Figure 41A:
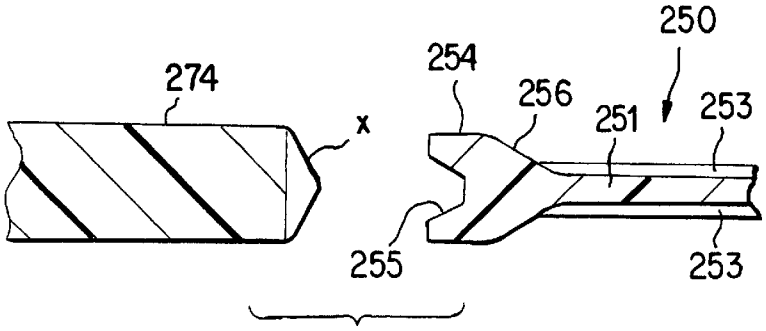
FIGS. 41A and 41B are partially expanded cross-sectional views showing the vicinity of contacting protruding ends of the base plate and the short circuit preventing member.
Figure 41B:
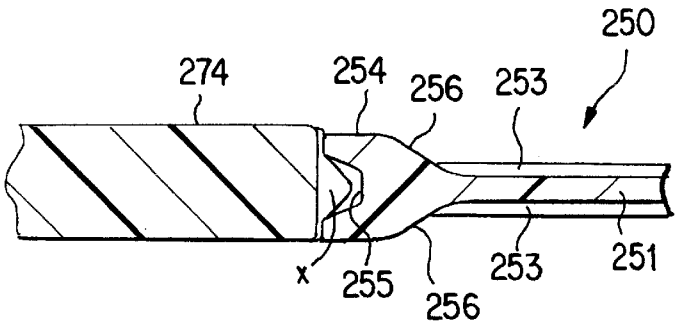
Figure 40:
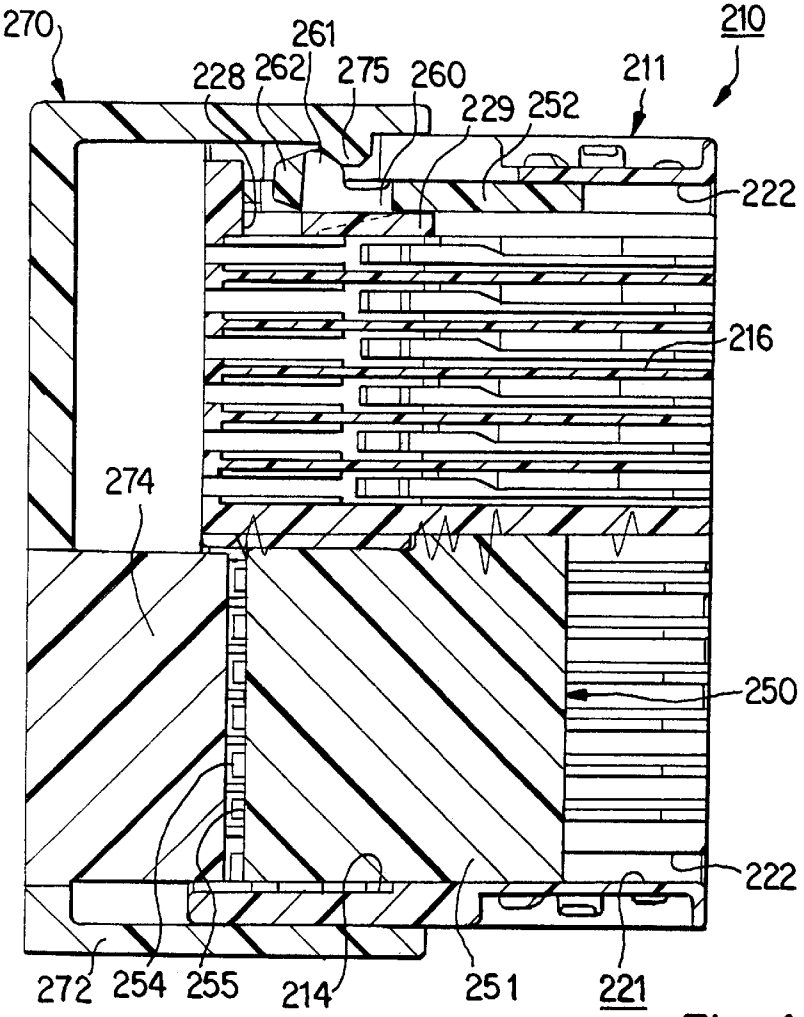
FIG. 40 is a plan cross-sectional view showing the base plates making contact with the short circuit preventing member.
Figure 42:
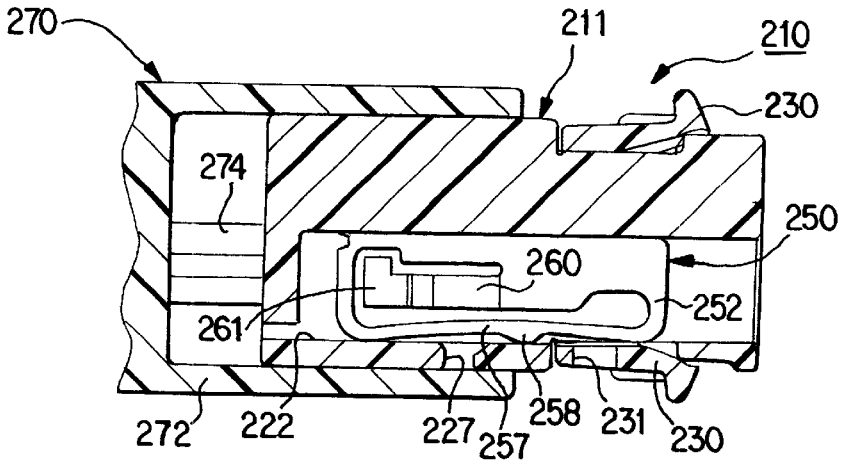
FIG. 42 is a side cross-sectional view showing the short circuit preventing member being moved between a short circuit preventing position and a retreated position.
Figure 43:
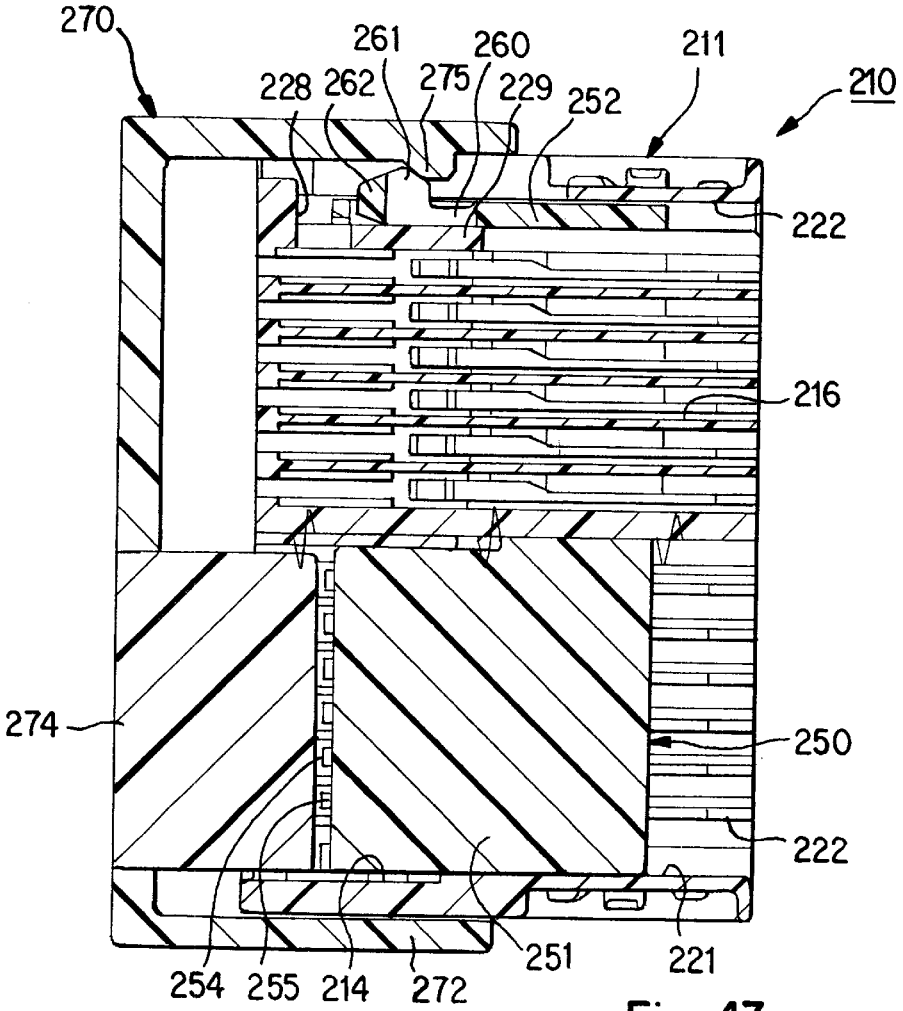
FIG. 43 is a plan cross-sectional view showing the short circuit preventing member being moved between the short circuit preventing position and the retreated position.
Figure 46:
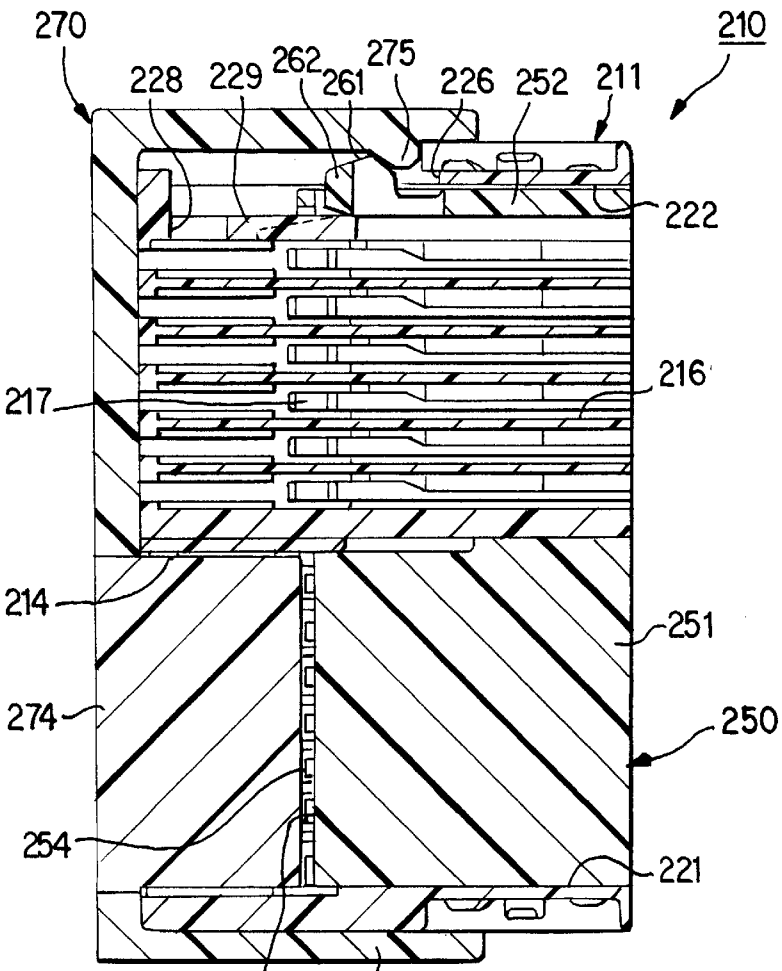
FIG. 46 is a plan cross-sectional view showing the correctly fitted state.
Figure 44:
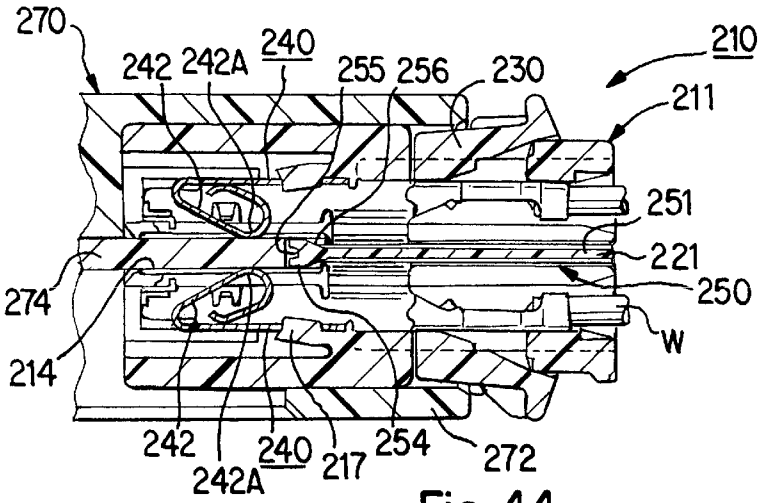
FIG. 44 is a side cross-sectional view showing a correctly fitted state.
Figure 45:
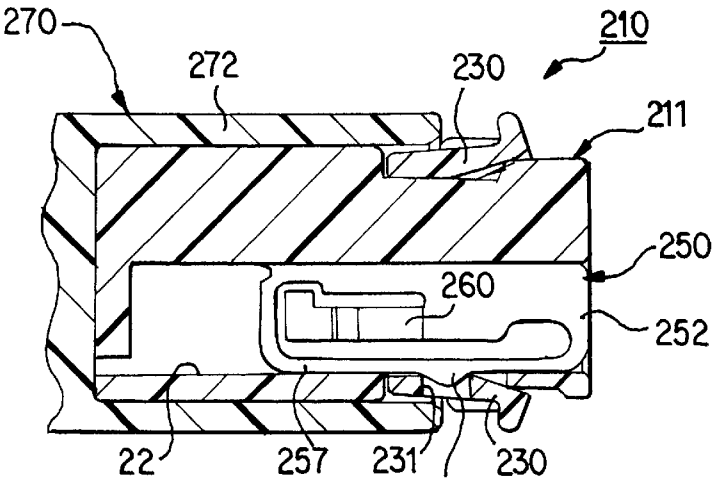
FIG. 45 is a side cross-sectional view showing the position fixing portions of the short circuit preventing member in the correctly fitted state.
Figure 47:
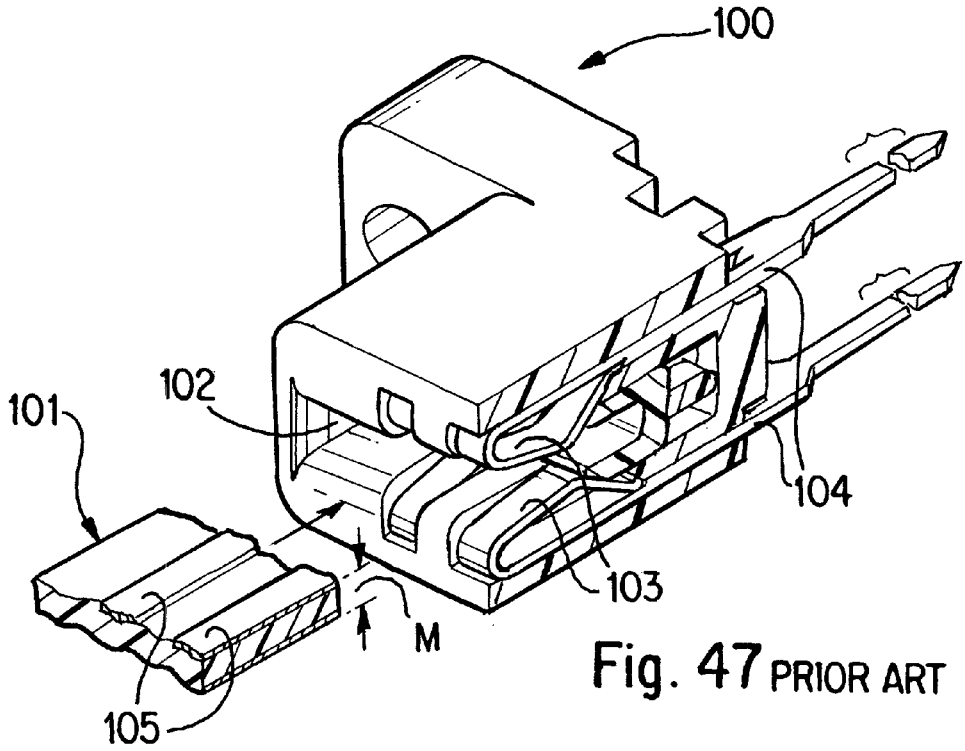
Fig. 47 PRIOR ART
FIG. 47 is a partial cross-sectional diagonal view of a prior art card edge connector.
Figure 48:
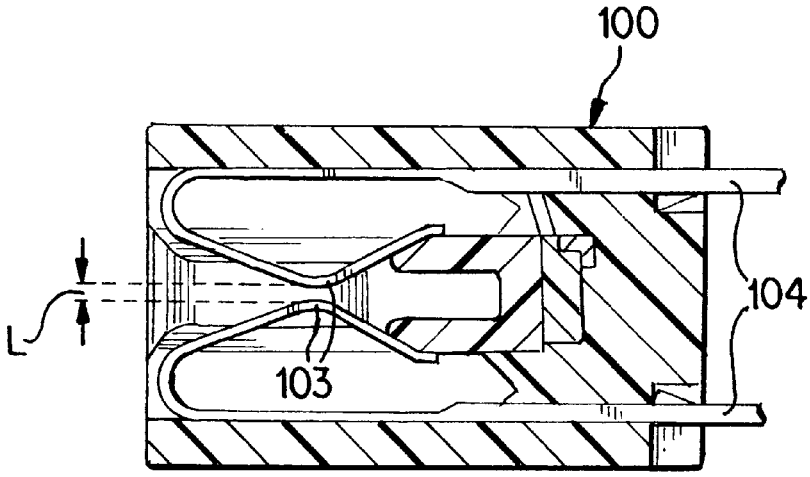
Fig. 48 PRIOR ART
FIG. 48 is a side cross-sectional view of the prior art card edge connector.

In the case where the two housings 81 and 90 are to be separated from the fitted state, they are pulled in a direction of mutual separation, the returning protrusions 92 pushing the retaining protrusions 78 in a direction of separation. At this juncture, the bending regulating walls 86 make contact with the inner sides, relative to the widthwise direction thereof, of the retaining arms 77, thereby preventing these retaining arms 77 from bending. consequently, the returning protrusions 92 and the retaining arms 77 are maintained in their engaged state. As a result, the short circuit preventing member 70 moves towards the anterior. As shown in FIG. 25, the bending edges 74 of the side wall members 72 bend, and the position fixing protrusions 75 are removed from the posterior position fixing holes 84B.

When the short circuit preventing member 70 has reached the short circuit preventing position, the bending edges 74 return to their original positions and the position fixing protrusions 75 engage with the anterior position fixing holes 84A, thereby fixing the position of the short circuit preventing member 70. When the two housings 81 and 90 are separated further, the returning protrusions 92 push the retaining protrusions 78 (see FIG. 24), the retaining arms 77 move into the recessed members 85, and the returning protrusions 92 are released from the retaining arms 77. Then, the retaining protrusions 78 rise over the returning protrusions 92 and the retaining arms 77 return to the original position. Thereupon, the two housings 81 and 90 return to their state prior to being fitted together (see FIGS. 19 and 23).

The present embodiment has the same operation and effects as the first embodiment, but does not have the bending regulating protrusions 59 on the upper faces of the retaining arms 57 that are provided in the first embodiment. Consequently, the retaining arms 77 of the second embodiment are smaller, in the up-down direction, by the extent of these bending regulating protrusions 59. As a result, the recessed members 85 (into which the retaining arms 77 bend) of the housing 81 are also smaller in the up-down direction. Consequently, the card edge connector 80 can be miniaturised as a whole.

Another embodiment of the present invention is described below with the aid of FIGS. 28 to 46, corresponding components have the same reference numerals as in the first embodiment, but preceded by 2.

The housing 211 fits with a corresponding housing 270 made from plastic and protruding in a unified manner from a side face of a piece of machinery or the like. In the following description, fitting sides of the two housings 211 and 270 are considered to be the anterior face sides.

This housing 211 fits into a hood 271 of the corresponding housing 270. When the two housings 211 and 270 have been fitted together, the locking arm 213 engages resiliently with a lock receiving member 272 upper portion of the hood 271.

Two left and right base plates 274 protrude from an inner face of the hood 271.

Two base plate insertion holes 214 open into an anterior face of the housing 211 at locations whereby the base plates 274 can be inserted therein from the anterior. These base plate insertion holes 214 extend to approximately the centre of the housing 211, relative to the lengthwise direction thereof. Thin film-shaped terminals (not shown) are provided on upper and lower faces of anterior end portions of the base plates 274.

A pair of concave retainer attachment holes 218, within which the retainers 230 are fitted, are formed in upper and lower faces of the housing 211.

The short circuit preventing member 250 is attached within the housing 211. For this purpose, a member housing hole 221, which is capable of housing the short circuit preventing member 250, is provided in a posterior face of the housing 211. This member housing hole 221 has an inverted U-shape when viewed cross-sectionally. The horizontal portion of the member housing 221 separate the upper and lower rows of cavities 216. A joining groove 224 passes through a central wall 223 of the member housing hole 221 to inner sides of the base plate insertion holes 14. This joining groove 224 has a height such that an isolating member 251 (to be described in detail later) of the short circuit preventing member 250 can be inserted tightly therein. Portions of the ceiling face and the base face of the joining groove 224 are open to the upper and lower cavities 216, this allowing the resilient contacts 242 of the terminal fittings 240 to pass therethrough. The left and right side ends of the member housing hole 221 form side grooves 222 that extend downwards. Window holes 226 pass through left and right side faces of the housing 211, these opening onto portions of the side grooves 222.

The isolating member 251 is thinner than the base plate 274, having a thickness whereby it can be inserted tightly into the joining groove 224 of the central wall 223.

Guiding grooves 253, which extend in an anterior-posterior direction, are formed in upper and lower faces of the short circuit preventing member 250 at locations corresponding to the cavities 216. The contacting members 42A of the resilient contacts 242 of the terminal fittings 240 are fitted into these guiding grooves 253, the sliding of these contacting members 242A thereby being guided. As shown in FIG. 210, a portion of an anterior end of each guiding groove 253 forms a thick member 254 that is approximately twice as thick as the guiding groove 253 and joins therewith via oblique members 256. A concave member 255 is formed in an anterior face of each thick member 254 at a central location thereof relative to the up-down direction. A burr x (to be described) can enter this concave member 255.

Portions of the anterior ends of the short circuit preventing member 250 that are not provided with thick members 254 are retreated as far as inner faces of the concave members 255. An anterior end of each thick member 254 is considered to be the anterior end of the short circuit preventing member 250 when this is in a contacting state.

The short circuit preventing member 250 is attached such that it can slide freely in an anterior-posterior direction from the member housing hole 221 to the base plate insertion holes 214. It can be maintained either in a short circuit preventing position (located at the anterior) or in a retreated position (located at the posterior). When the short circuit preventing member 250 is in the short circuit preventing position, the isolating member 251 thereof is positioned between the resilient contacts 242 of the terminal fittings 240 protruding upwards and downwards into the base plate insertion holes 214, thereby separating these resilient contacts 242. When the short circuit preventing member 250 is in the retreated position, the isolating member 251 has retreated to a location to the posterior of the resilient contacts 242 of the upper and lower terminal fittings 240.

Slits are formed in inner sides of lower end portions of the side wall members 252 of the short circuit preventing member 250, thus forming bending members 257. A retaining protrusion 258 protrudes from an approximately central portion of a lower face of each bending member 257. A position fixing hole 227 is formed in a base face of each of the side grooves 222 of the member housing 221. Anterior ends of the side wall members 252 make contact with the side grooves 222, and the retaining protrusions 258 fit into the position fixing holes 227, thereby maintaining the short circuit preventing member 250 in the short circuit preventing position. Further, other position fixing holes 231 are formed in the lower retainer 230 which is attached at a location to the posterior of the position fixing holes 227. These position fixing holes 231 are provided at locations corresponding to the base faces of the side grooves 222. When the retaining protrusions 258 engage with the position fixing holes 231, the short circuit preventing member 250 is maintained in the retreated position.

A retaining arm 260 is formed in each of the side wall members 252 at a location above the slits. These retaining arms 260 extend in a cantilevered shape towards the anterior from an approximately central location of each side wall member 252, relative to the lengthwise direction thereof. These retaining arms 260 are capable of bending in a widthwise direction relative to the side wall members 252. A retaining protrusion 261, which protrudes outwards, is formed on a tip of each retaining arm 260. When the retaining arms 260 are in a natural, unbent state the retaining protrusions 261 protrude into the window holes 226 of the housing 211. A bending regulating protrusion 262 protrudes upwards from a tip of each retaining protrusion 261.

Recessed members 228 are formed in a concave manner in inner faces of the side grooves 222 of the housing 211. These recessed members 228 allow the retaining arms 260 to bend. As shown in FIG. 216, long and narrow bending regulating walls 229 extend in an anterior-posterior direction at the posterior of the recessed members 228. These bending regulating walls 229 make contact with inner sides of the bending regulating protrusions 262. When the short circuit preventing member 250 is located to the posterior relative to the short circuit preventing position, the bending regulating walls 229 prevent the retaining arms 260 from bending. When the short circuit preventing member 250 is in the short circuit preventing position, the bending regulating protrusions 262 are located to the anterior of the bending regulating walls 229, this allowing the retaining arms 260 to bend.

A pair of returning protrusions 275 are formed in left and right inner side faces of the hood 271 of the corresponding housing 270. When the two housings 211 and 270 have been fitted together, these returning protrusions 275 engage with the retaining protrusions 261 of the retaining arms 260.

The present embodiment is confugured as described above. Next, the operation thereof will be described.

When the short circuit preventing member 250 is inserted from the posterior into the member housing hole 221 of the housing 211, an anterior end of the isolating member 251 is pushed through the joining groove 224 of the central wall 223, and the short circuit preventing member 250 is maintained in the short circuit preventing position. Then, the terminal fittings 240 are inserted from the posterior into the cavities 216, the contacting members 242A thereof sliding within the guiding grooves 253 of the short circuit preventing member 250. After the terminal fittings 240 have been pushed in to a correct position, they are retained by the lances 217. Then the retainers 230 are moved to the main retaining position, thereby doubly retaining the terminal fittings 240. At this juncture, the isolating member 251 of the short circuit preventing member 250 enters between and separates the mutually facing upper and lower terminal fittings 240, and the contacting members 242A of the resilient contacts 242 make resilient contact with groove bases of the guiding grooves 253. In this manner, the upper and lower terminal fittings 240 are prevented from short circuiting.

From this state, the housing 211 is fitted into the hood 271 of the corresponding housing 270. While the two housings 211 and 270 are being fitted together, the returning protrusions 275 strike against the retaining protrusions 261, this bending the retaining arms 260 into the recessed members 228. Moreover, tips of the base plates 274 are inserted into the corresponding base plate insertion holes 214.

As fitting progresses, the returning protrusions 275 pass over the retaining protrusions 261, the retaining arms 260 returning to their original shape and being released from the recessed members 228. By this means, the returning protrusions 275 engage from the posterior with the retaining protrusions 261. At approximately the same time, anterior ends of the base plates 274 strike against the anterior end of the isolating members 251 of the short circuit preventing member 250.

The anterior ends of the base plates 274 are sheared off in the direction of the thickness of these plates, this making it highly likely that burrs x will be formed. In this embodiment, the concave members 255 are formed in the portion of the anterior end of the short circuit preventing member 250 which is provided with the thick members 254, these concave members 255 allowing the burrs x to enter therein. The remaining portions of the anterior end of the short circuit preventing member 250 are retreated towards the posterior. The burr x (if present) fits either into the concave members 255 or into the retreated portions of the short circuit preventing member 250, the anterior ends of the base plates 274 making contact with the anterior ends of the thick members 254. That is, the anterior ends of the base plates 274 make contact with the anterior ends of the thick members 254 in the same way as they would if no burr x were present.

As the fitting of the two housings 211 and 270 progresses further, the short circuit preventing member 250 is pushed towards the posterior by the base plates 274 while these base plates 274 are being inserted into the base plate insertion holes 214. Then, the bending members 257 of the side wall members 252 of the short circuit preventing member 250 bend upwards, and the position fixing protrusions 258 rise over the base faces of the side grooves 222. In this state, the short circuit preventing member 250 is moved into the retreated position. Simultaneously, the resilient contacts 242 of the upper and lower terminal fittings 240 bend, rising first over the oblique members 256 then over the upper and lower faces of the thick members 254. As insertion continues, the resilient contacts 242 continue past the anterior ends of the base plates 274 which have been inserted. By this means, the contacting members 242A of the upper and lower resilient contacts 242 resiliently grip the base plates 274.

When the housing 211 has reached a correct position, the locking arm 213 engages with the lock receiving member 272 of the corresponding housing 270, this locking the two housings 211 and 270 in a fitted state. Furthermore, the bending members 257 of the side wall members 252 of the short circuit preventing member 250 return to their original position, and the position fixing protrusions 258 fit into and engage with the position fixing holes 231 of the lower retainer 230, this maintaining the short circuit preventing member 250 in the retreated position. At this juncture, the base plates 274 are resiliently gripped between the contacting members 242A of the upper and lower resilient contacts 242, these contacting members 242A making contact with the terminals provided on the faces of the base plates 274, and each circuit between the terminal fittings 240 and the base plates 274 making electrical contact. In this manner, the fitting operation of the two housings 211 and 270 is completed.

In the case where the two housings 211 and 270 are to be separated from a fitted state, the locking arm 213 is first pushed downwards, this releasing it from its engagement with the lock receiving member 272. Then, from this state, the housing 211 is pulled towards the posterior. As this is done, the base plates 274 leave the base plate insertion holes 214, and the returning protrusions 275 engage with the retaining protrusions 261. At this juncture, the bending regulating walls 229 make contact with the inner sides of the bending regulating protrusions 262, thereby preventing the retaining arms 260 from bending. Consequently, the returning protrusions 275 and the retaining protrusions 261 are maintained in their engaged state. As a result, the short circuit preventing member 250 moves towards the anterior while the bending members 257 bend and the position fixing protrusions 258 are removed from the position fixing holes 231 of the retainer 230.

The base plates 274 and the short circuit preventing member 250 are moved while their contacting protruding ends are in a mutually contacting state; then the anterior ends of the base plates 274 are removed from between the reislient contacts 242 of the upper and lower terminal fittings 240. Next, after the upper and lower resilient contacts 242 have risen over both faces of the thick members 254 of the short circuit preventing member 250, these resilient contacts 242 return to their original position, moving slightly towards one another while sliding along the oblique members 256, then making resilient contact with the groove bases of the guiding grooves 253.

When the short circuit preventing member 250 reaches the short circuit preventing position, it makes contact with the anterior faces of the side grooves 222. This prevents the short circuit preventing member 250 from moving towards the anterior. Further, the position fixing protrusions 258 are engaged with the position fixing holes 227 located at the anterior, thereby maintaining the position of the short circuit preventing member 150. Moreover, the bending regulating protrusions 262 are located to the anterior of the bending regulating walls 229, in a location whereby they do not interfere therewith.

When the housing 211 is pulled out further, the returning protrusions 275 push the bending regulating protrusions 262, the retaining arms 260 are moved into the recessed members 228, and the engeged state of the returning protrusions 275 and the retaining protrusions 261 is released.

Then, the base plates 274 are removed from the base plate insertion holes 214, the retaining protrusions 261 pass over the returning protrusions 275 and the retaining arms 260 return to their original position. In this manner, the housing 211 is removed from the hood 271, and the two housings 211 and 270 return to their state prior to being fitted together.

In the present embodiment, the short circuit preventing member 250 is located between the terminal fittings 240, this preventing them from short circuiting. As a result, the mutually opposing resilient contacts 242 can readily be caused to bend to a greater degree towards one another, thus increasing their contacting force with the terminals on the base plates 274 and allowing a stable contacting state to be obtained.

The anterior ends of the base plates 274 that push the short circuit preventing member 250 are likely to have burrs x formed thereon due to their being sheared off in the direction of the thickness of these plates. If these burrs x push portions of the anterior end of the isolating member 251, this causes a space to form between the mutually contacting protruding ends of the base plates 274 and the short circuit preventing member 250. Consequently, there is the problem that the resilient contacts 242 of the terminal fittings 240 may make contact via this space while the short circuit preventing member 250 is being pushed in.

The present embodiment addressed this problem by providing the concave members 255 in the thick members 254 at the anterior end of the isolating member 251 of the short circuit preventing members 250, these concave members 255 allowing the burrs x to enter therein. The portion remaining (i.e. the portion of the isolationg member 251 not provided with the thick members 254) is retreated towards the posterior. As a result, the burrs x (if present) fits either into the concave members 255 or into these retreated portions. That is, the anterior ends of the base plates 274 make contact with the anterior ends of the thick members 254 in the same way as they would if no burrs x were present.

As a result, almost no space is formed at the location where the upper and lower terminal fittings 240 are provided, between the contacting protruding ends of the base plates 274 and the isolating members 251 of the short circuit preventing member 250. Consequently, the resilient contacts 242 of the upper and lower terminal fittings 240 do not make contact (that is, they do not short circuit).

Further, the burrs x are housed within the concave members 255 at the location where the upper and lower terminal fittings 240 are provided. Consequently, the burrs x will not come between the resilient contacts 242 and damage the electrical contact as a result of (for example) being torn off and coming to rest on the terminals.

Further, the burrs x (if present) cause the anterior ends of the base plates 274 to protrude to a greater extent, which causes these base plates 274 to being pushing the short circuit preventing member 250 at an earlier stage. In that case, the short circuit preventing member 250 may, for example, return to the retreated position before the two housings 211 and 270 have been correctly fitted together. At this juncture, mutual resistance would halt the fitting operation. That is, the fitting operation would halt before the two housings 211 and 270 have been locked together, this leaving the two housings 211 and 270 in an unstable state.

The present embodiment has addressed this problem by preventing the burrs x, if present, from causing the anterior ends of the base plates 274 to protrude further. Consequently, the base plates 274 push the short circuit preventing member 250 at the correct time, and the prescribed operations, such as locking the two housings 211 and 270 together, can be obtained.

The present invention is not limited to the embodiments described above with the aid of figures. For example, the possibilities described below also lie within the technical range of the present invention.

(1) In the embodiments described above, the short circuit preventing member can be moved, within the housing, between the short circuit preventing position and the retreated position. However, according to the present invention, the short circuit preventing member may equally well be located at the exterior of the housing when it is in the retreated position.

(2) In the embodiments described above, the base plates directly push the short circuit preventing member while they are being inserted. However, according to the present invention, a member other than the base plates (the corresponding housing, for example) may equally well push the short circuit preventing member. Further, the short circuit preventing member may be moved into the retreated position in an operation which is separate from the insertion of the base plates.

(3) In the embodiments described above, when the base plates are removed from the base plate insertion holes, the retaining means (the retaining arms and the returning protrusions) return the short circuit preventing member to the short circuit preventing position. However, according to the present invention, the short circuit preventing member can equally well be returned to the short circuit preventing position in an operation which is separate from the removal of the base plates.

(4) In the embodiments described above, the operations of fitting the two housings together and separating them (the operations of inserting and removing the base plates) is accompanied by the retaining means (the retaining arms and the returning protrusions) being mutually engaged and released. However, according to the present invention, this engaging and releasing can equally well occur as a separate operation.

(5) In the third embodiment contact of the upper and lower terminal fittings via the space between the mutually contacting protruding ends of the base plates and the short circuit preventing member may be prevented as long as this space does not extend in a straight line relative to the direction of thickness of the plates. For this reason, in order to prevent short circuiting, it is sufficient that the mutually contacting protruding ends of the base plates and the short circuit preventing member mutually overlap.

What is claimed is:

1. A card edge connector comprising a housing having a slot adapted to receive the edge of a card having surface contacts, and opposed resilient terminals within said slot and adapted to grip said surface contacts, said connector further including a short circuit preventing member of electrically insulating material and a resilient latch, said preventing member being movable from an advanced position between said opposed terminals to a retreated position rearward of said opposite terminals, and said resilient latch being adapted to releasably retain said preventing member in the advanced and retreated positions.

2. A connector according to claim 1 wherein said latch comprises a flexible arm of said preventing member, said arm being engageable in a recess of said housing.

3. A connector according to claim 1 wherein said preventing member is directly movable by a card edge connector inserted into said slot.

4. A connector according to claim 3 wherein said preventing member has a contact edge for direct engagement with said card edge connector, said contact edge having a depression extending laterally thereof.

5. A connector according to claim 4 wherein said depression comprises the full thickness of said edge.

6. A connector according to claim 4 wherein said contact edge is castellated, a plurality of successive depressions being provided on said edge.

7. A connector according to claim 5 wherein said contact edge is castellated, a plurality of successive depressions being provided on said edge.

8. A card edge connector comprising a housing having a slot adapted to receive the edge of a card having surface contacts, and opposed resilient terminals within said slot and adapted to grip said surface contacts, said connector further including a short circuit preventing member of electrically insulating material, said preventing member being movable from an advanced position between said opposed terminals to a retreated position rearward of said opposite terminals, and further including a support member having a card edge connector thereon, said support member and said housing being movable together and apart on an insertion axis, said support member and said preventing member having mutually engagable abutments whereby said preventing member is entrained for movement with said support member along said insertion axis between predetermined limits.

9. A connector according to claim 8 wherein said predetermined limits comprise abutment of said support member and housing when said preventing member is in the retreated position, and abutment of said preventing member and housing in the advanced condition.

10. A connector according to claim 8 wherein said mutually engageable abutments comprise a resilient leg of said preventing member and a protrusion of said support member.

11. A connector according to claim 9 wherein said mutually engageable abutments comprise a resilient leg of said preventing member and a protrusion of said support member.

* * * * *